US007559303B2

(12) United States Patent
Sakai et al.

(10) Patent No.: US 7,559,303 B2
(45) Date of Patent: Jul. 14, 2009

(54) STARTUP TORQUE TRANSMITTING MECHANISM OF AN INTERNAL COMBUSTION ENGINE

(75) Inventors: Kazuhito Sakai, Makinohara (JP); Toshiaki Asada, Mishima (JP); Makoto Ishikawa, Nishikamo-gun (JP); Tomoaki Suzuki, Nagoya (JP); Toshimitsu Shiba, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 11/996,806

(22) PCT Filed: Jul. 25, 2006

(86) PCT No.: PCT/IB2006/002017

§ 371 (c)(1),
(2), (4) Date: Jan. 25, 2008

(87) PCT Pub. No.: WO2007/012943

PCT Pub. Date: Feb. 1, 2007

(65) Prior Publication Data

US 2008/0163843 A1 Jul. 10, 2008

(30) Foreign Application Priority Data

Jul. 29, 2005 (JP) ..... 2005-220106

(51) Int. Cl.
*F02N 11/00* (2006.01)

(52) U.S. Cl. ..... 123/179.25; 74/6

(58) Field of Classification Search ..... 123/179.25, 123/179.26, 179.28; 74/6, 7 C, 15.63; 192/45, 192/45.1

See application file for complete search history.

(56) References Cited

U.S. PATENT DOCUMENTS

| | | | | |
|---|---|---|---|---|
| 5,265,706 | A * | 11/1993 | Iga | 192/42 |
| 5,966,985 | A * | 10/1999 | Shuto et al. | 74/7 C |
| 2008/0163842 | A1 * | 7/2008 | Forssell et al. | 123/179.25 |

FOREIGN PATENT DOCUMENTS

| | | | |
|---|---|---|---|
| DE | 195 46 708 | A1 | 6/1997 |
| DE | 103 43 400 | A1 | 4/2005 |
| JP | 10-122107 | A | 5/1998 |
| JP | 2000-274337 | A | 10/2000 |
| JP | 2003-83216 | A | 3/2003 |
| JP | 2005-3197 | A | 1/2005 |
| WO | WO 2006/016668 | A1 | 2/2006 |

* cited by examiner

*Primary Examiner*—Stephen K Cronin
*Assistant Examiner*—David Hamaoui
(74) *Attorney, Agent, or Firm*—Sughrue Mion, PLLC

(57) ABSTRACT

A torque transmitting mechanism, including a ring gear; a crankshaft side member which rotates in conjunction with a crankshaft; a one-way clutch arranged between the ring gear and the crankshaft; a bearing arranged between the crankshaft or the crankshaft side member and a surface of the ring gear that faces in the opposite direction from the side of the ring gear on which the one-way clutch is arranged; a first oil seal member arranged together with the bearing between the crankshaft or the crankshaft side member and the surface of the ring gear that faces in the opposite direction from the side of the ring gear on which the one-way clutch is arranged, and is arranged on the opposite side of the bearing from the internal combustion engine main body; and a second oil seal arranged between the ring gear and the internal combustion engine main body.

6 Claims, 14 Drawing Sheets

STARTUP TORQUE TRANSMITTING MECHANISM OF AN INTERNAL COMBUSTION ENGINE

BACKGROUND OF THE INVENTION

1. Field of the Invention

The invention relates to a startup torque transmitting mechanism of an internal combustion engine, which rotates a crankshaft by transmitting torque from a ring gear to the crankshaft via a one-way clutch during startup.

2. Description of the Related Art

Japanese Patent Application Publication No. JP-A-2003-83216, for example, discloses a startup torque transmitting mechanism of an internal combustion engine, in which a one-way clutch (i.e., a reverse input interruption clutch) is provided between a starter motor and a crankshaft such that the starter motor side can be in constant mesh with a ring gear. In particular, according to the related structure illustrated in page 2 and FIG. 7 of that publication, for example, the ring gear is supported by the crankshaft side via a bearing provided between it and the crankshaft and the one-way clutch is arranged between a reduction gear and a drive gear.

When the bearing and the one-way clutch are both provided in this manner, an oil seal member that seals the inside and outside of the internal combustion engine is particularly important. Because the bearing and the one-way clutch are arranged around the crankshaft in this case, however, the oil seal member must have a large diameter, which means the lip portion of the oil seal member slides at a high rate of speed while the internal combustion engine is operating. As a result, the oil seal member may degrade more quickly.

DISCLOSURE OF THE INVENTION

In view of the foregoing technical issues, it is an object of this invention to prevent a lip portion of an oil seal member from sliding at a high rate of speed in a startup torque transmitting mechanism of an internal combustion engine, which rotates a crankshaft by transmitting torque from a ring gear to a crankshaft via a one-way clutch during startup.

In order to achieve this object, a first to a fourteenth aspect of the invention relates to a startup torque transmitting mechanism of an internal combustion engine, which is provided with a one-way clutch between a ring gear to which torque is transmitted from a starter motor side and a crankshaft side member that rotates in conjunction with a crankshaft, the one-way clutch transmitting torque generated by the starter motor from the ring gear to the crankshaft in one direction and preventing torque from being transmitted in the other direction, and in which a bearing is arranged between an internal combustion engine main body and a surface of the ring gear that faces in the opposite direction from the side of the ring gear on which the one-way clutch is provided; both the bearing and the one-way clutch require no supply of lubrication oil; and an oil seal member is arranged between the internal combustion engine main body and the crankshaft or the crankshaft side member.

Because the oil seal member is arranged between the internal combustion engine main body and the crankshaft or the crankshaft side member in this way, oil within the internal combustion engine main body is prevented from leaking out. Moreover, neither the bearing nor the one-way clutch requires a supply of lubrication oil. As a result, no problems will occur in terms of lubrication of both the bearing and the one-way clutch even if no lubrication oil is supplied to either of the two due to the oil seal member being arranged between the internal combustion engine main body and the crankshaft or the crankshaft side member.

Also, the oil seal member need only provide a seal between the internal combustion engine main body and the crankshaft or the crankshaft side member so the entire oil seal member does not need to have a large diameter. As a result, even when the crankshaft or the crankshaft side member rotates while the internal combustion engine is operating, the oil seal member will not slide at a high rate of speed due to its small diameter, and thus will not degrade quickly.

According to a second aspect of the invention, in the first aspect, the ring gear forms an inner race of the one-way clutch and the crankshaft side member forms an outer race of the one-way clutch.

As a result, the one-way clutch, the bearing, and the oil seal member are all covered by the crankshaft side member. Hence, in particular, lubrication oil is not supplied and foreign matter from the outside is inhibited from getting into the one-way clutch and the bearing which are not sealed off from the outside by an oil seal member Furthermore, foreign matter is prevented from wearing away the oil seal member, thus enabling good oil sealability to be maintained.

According to a third aspect of the invention, in the first or second aspect, both the bearing and the one-way clutch are grease-filled and so do not need to be supplied with lubrication oil.

Since the bearing and the one-way clutch are grease-filled in this way, they are able to function smoothly even without lubrication oil being supplied.

According to the fourth to a fifteenth aspect of the invention, a startup torque transmitting mechanism of an internal combustion engine, which is provided with a one-way clutch between a ring gear to which torque is transmitted from a starter motor side and a crankshaft side member that rotates in conjunction with a crankshaft, the one-way clutch transmitting torque generated by the starter motor from the ring gear to the crankshaft in one direction and preventing torque from being transmitted in the other direction, is such that a bearing and a first oil seal member are arranged between the crankshaft or the crankshaft side member and a surface of the ring gear that faces in the opposite direction from the side of the ring gear on which the one-way clutch is provided; the first oil seal member is arranged on the opposite side of the bearing from the internal combustion engine main body; the one-way clutch requires no supply of lubrication oil; and a second oil seal member is arranged between the ring gear and the internal combustion engine main body.

Providing two oil seal members in this way prevents oil within the internal combustion engine main body from leaking out. Also, because the bearing is on the internal combustion engine main body side of the first oil seal member, it can be supplied with lubrication oil from within the internal combustion engine main body. The one-way clutch does not need to be supplied with lubrication oil so no problems arise in terms of lubrication of the one-way clutch even if the one-way clutch is arranged on the opposite side of the ring gear from the first oil seal member.

In this case, the first oil seal member is arranged between the ring gear and the crankshaft or the crankshaft side member and so does not have to have a large diameter. As a result, even when the crankshaft or the crankshaft side member rotates while the internal combustion engine is operating, the oil seal member will not slide at a high rate of speed due to its small diameter, and thus will not degrade quickly.

Also, because the ring gear does not rotate with respect to the internal combustion engine while the internal combustion engine is operating after startup and the second oil seal member is arranged between the ring gear and the internal combustion engine main body, the second oil seal member will not slide while the internal combustion engine is operating and so can have a large diameter without degrading quickly as a result.

Therefore, the oil seal members do not slide at a high rate of speed or slide at all while the internal combustion engine is operating so neither will degrade quickly.

According to a fifth aspect of the invention, in the fourth aspect, the ring gear forms an inner race of the one-way clutch and the crankshaft side member forms an outer race of the one-way clutch.

As a result, the one-way clutch, the bearing, and the first oil seal member are all covered by the crankshaft side member. Hence, in particular, lubrication oil is not supplied and foreign matter from the outside is inhibited from getting into the one-way clutch which is not sealed off from the outside by an oil seal member. Furthermore, foreign matter is prevented from wearing away the first oil seal member even if the first oil seal member slides while the internal combustion engine is operating, thus enabling good oil sealability to be maintained.

According to a sixth aspect of the invention, in the fourth or fifth aspect, the one-way clutch is grease-filled and so does not need to be supplied with lubrication oil.

Since the one-way clutch is grease-filled in this way, it can function smoothly even without lubrication oil being supplied.

According to a seventh to a sixteenth aspect of the invention, a startup torque transmitting mechanism of an internal combustion engine, which is provided with a one-way clutch between a ring gear to which torque is transmitted from a starter motor side and a crankshaft side member that rotates in conjunction with a crankshaft, the one-way clutch transmitting torque generated by the starter motor from the ring gear to the crankshaft in one direction and preventing torque from being transmitted in the other direction, is such that a bearing is arranged between the crankshaft or the crankshaft side member and a surface of the ring gear that faces in the opposite direction from the side of the ring gear on which the one-way clutch is provided; the bearing has an oil seal function; the one-way clutch requires no supply of lubrication oil; and an oil seal member is arranged between the ring gear and an internal combustion engine main body.

In this way, the bearing has an oil seal, and moreover, the oil seal member is arranged between the ring gear and the internal combustion engine main body so oil in the internal combustion engine main body will not leak out. Also, although the oil seal function of the bearing prevents lubrication oil from leaking out of the internal combustion engine main body, the bearing itself is lubricated by oil from the internal combustion engine main body. Also, the one-way clutch does not need to be supplied with lubrication oil so even if lubrication oil is not supplied, no problems will occur in terms of lubrication of the one-way clutch.

According to this structure, the bearing having the oil seal is arranged between the ring gear and the crankshaft or the crankshaft side member so the oil seal that is incorporated into the bearing does not have to have a large diameter.

Also, because the ring gear does not rotate with respect to the internal combustion engine while the internal combustion engine is operating after startup and the oil seal member is arranged between the ring gear and the internal combustion engine main body, the oil seal member will not slide while the internal combustion engine is operating so it can have a large diameter without degrading quickly as a result.

Therefore, the oil seal member does not slide at all while the internal combustion engine is operating and the oil seal incorporated into the bearing will not slide at a high rate of speed. Hence, neither the oil seal of the bearing nor the oil seal member will degrade quickly.

According to an eighth aspect of the invention, in the seventh aspect, the ring gear forms an inner race of the one-way clutch and the crankshaft side member forms an outer race of the one-way clutch.

As a result, the one-way clutch and the bearing are covered by the crankshaft side member. Hence, in particular, lubrication oil is not supplied and foreign matter from the outside is inhibited from getting into the one-way clutch which is not sealed off from the outside by an oil seal member The oil seal of the bearing is also covered so foreign matter is prevented from wearing away this oil seal, thus enabling good oil sealability to be maintained.

According to a ninth aspect of the invention, in the seventh or eighth aspect, the one-way clutch is grease-filled and so does not need to be supplied with lubrication oil.

Since the one-way clutch is grease-filled in this way, it can function smoothly even without lubrication oil being supplied.

According to a tenth and a seventeenth aspect of the invention, a startup torque transmitting mechanism of an internal combustion engine, which is provided with a one-way clutch between a ring gear to which torque is transmitted from a starter motor side and a crankshaft side member that rotates in conjunction with a crankshaft, the one-way clutch transmitting torque generated by the starter motor from the ring gear to the crankshaft in one direction and preventing torque from being transmitted in the other direction, is such that a bearing is arranged together with the one-way clutch between the ring gear and the crankshaft side member; both the bearing and the one-way clutch require no supply of lubrication oil; and an oil seal member is arranged between an internal combustion engine main body and the crankshaft or the crankshaft side member.

In this way, the bearing is arranged together with the one-way clutch between the ring gear and the crankshaft side member. Also, neither the bearing nor the one-way clutch need to be supplied with lubrication oil so no problems with occur in terms of lubrication of the bearing and the one-way clutch even if lubrication oil is not supplied.

The oil seal member is arranged between the internal combustion engine main body and the crankshaft or the crankshaft side member so oil in the internal combustion engine main body will not leak out and the oil seal member does not have to have a large diameter. Accordingly, the oil seal member does not slide at a high rate of speed while the internal combustion engine is operating and so will not degrade quickly.

According to an eleventh aspect of the invention, in the tenth aspect, the ring gear forms an inner race of the one-way clutch, the crankshaft side member forms an outer race of the one-way clutch, and the bearing is arranged between the inner race and the outer race.

Structuring the one-way clutch and the bearing in this way makes it possible to cover the one-way clutch and the bearing by sandwiching them between the crankshaft side member and the ring gear. Hence, in particular, lubrication oil is not supplied and foreign matter from the outside is inhibited from getting into the one-way clutch and the bearing which are not sealed off from the outside by an oil seal member.

According to a twelfth aspect of the invention, in the tenth or eleventh aspect, both the bearing and the one-way clutch are grease-filled and so do not need to be supplied with lubrication oil.

Since the bearing and the one-way clutch are grease-filled in this way, they are able to function smoothly even without lubrication oil being supplied.

According to a thirteenth aspect of the invention, in any one of the first to the twelfth aspects, the one-way clutch is formed between a surface formed by the ring gear that faces in the outer radial direction and a surface formed by the crankshaft side member that opposes that surface and faces in the inner radial direction.

Accordingly, the one-way clutch, the bearing, and the oil seal member are all covered by the crankshaft side member, which is particularly effective in inhibiting foreign matter from entering from outside the internal combustion engine.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE PREFERRED EMBODIMENTS

First Embodiment

Figure 1:
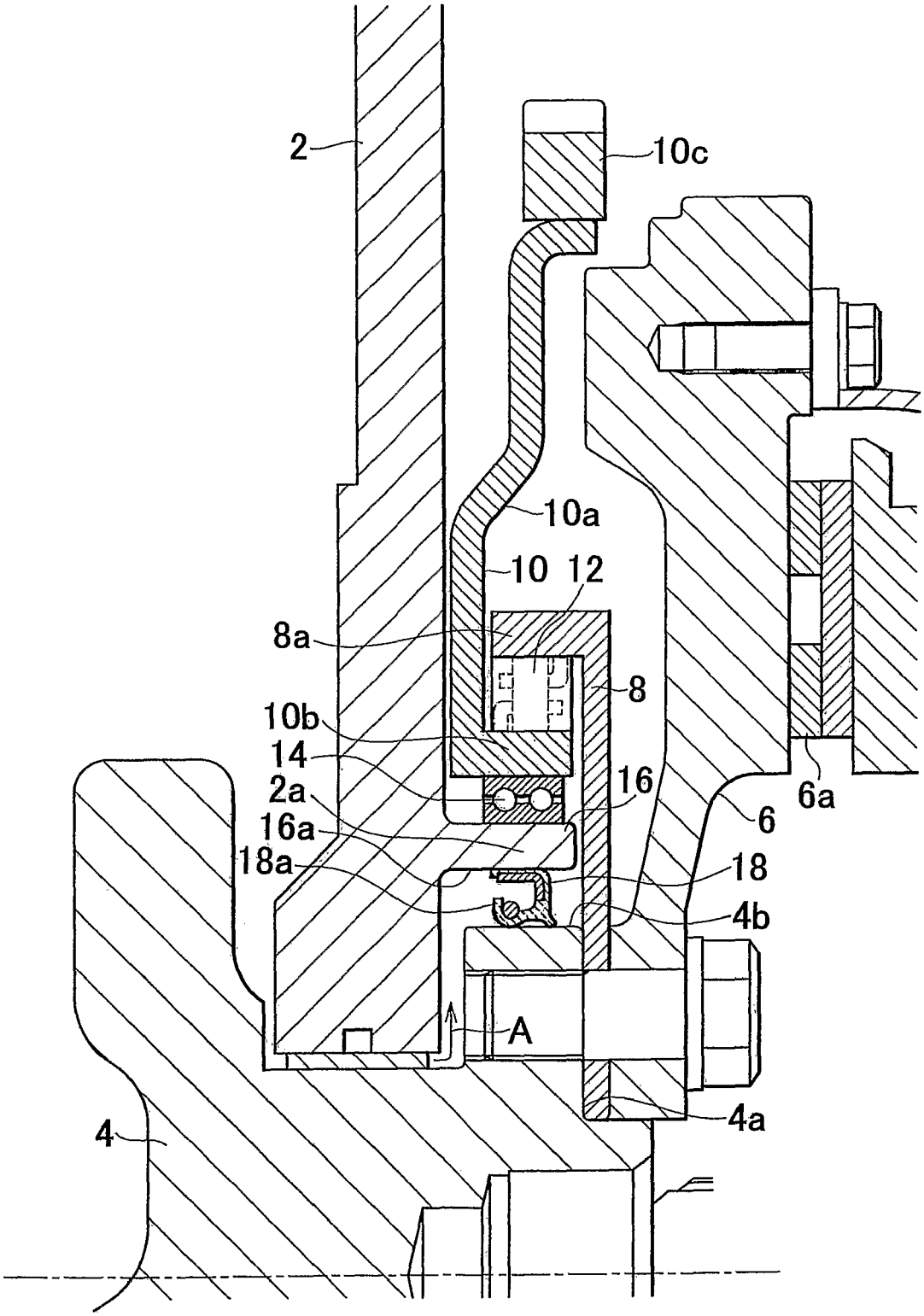
FIG. 1 is a longitudinal sectional view of a startup torque transmitting mechanism of an internal combustion engine according to a first embodiment of the invention.

FIG. 1 is a longitudinal sectional view of a startup torque transmitting mechanism of an internal combustion engine for a vehicle, showing an area of the rear side of the internal combustion engine where power is output to the transmission side.

A rear end of a crankshaft 4 that is rotatably supported by a ladder beam is arranged below, in the drawing, a cylinder block 2 of an internal combustion engine. A flywheel 6 and an outer race support plate 8 (which can be regarded as a crankshaft side member in the claims) are mounted to the rear end (the right end in the drawing) of the crankshaft 4. A ring gear 10 is mounted on the cylinder block 2 side.

The flywheel 6, the upper half of which is shown in FIG. 1, is substantially disc-shaped, with the center portion being open in the shape of a circle. A ring-shaped clutch disc 6*a*, which serves as a portion of a clutch mechanism for transmitting torque to and from a transmission, is mounted to the flywheel 6 on the side opposite the side that contacts the outer race support plate 8. The clutch mechanism may also be formed separate from the flywheel 6.

The outer race support plate 8, the upper portion of which is shown in FIG. 1, is formed in a flat circular shape with the center portion open. The outer race support plate 8 is fixed by a bolt both to the flywheel 6 and to a rear end surface 4*a* of the crankshaft 4 at a portion around the center opening. As a result, the outer race support plate 8 rotates in conjunction with both the flywheel 6 and the crankshaft 4. An outer race 8*a* of the one-way clutch 12 is formed around an outer peripheral portion of the outer race support plate 8.

The ring gear 10, the upper half of which is shown in FIG. 1, is a circular disc in which the center portion is largely open and which has a curved portion 10*a* midway in the radial direction. The ring gear 10 also has a flange-shaped inner race 10*b* of the one-way clutch 12 at the center open portion, and a ring-shaped gear portion 10*c* at the outer peripheral portion. This ring gear 10 is supported by an annular bearing mounting member 16 formed on the internal combustion engine main body side (i.e., the cylinder block 2 and oil pan side in this embodiment) via a bearing 14 (a roller bearing is used in this embodiment) at the surface on the inner peripheral side of the inner race 10*b*.

The bearing mounting portion 16 includes a semicircular peripheral surface portion 2*a* formed protruding in a semicircle on the rear portion side of the cylinder block 2, and a semicircular surface portion that continues on from this semicircular surface portion 2*a* on the cylinder block 2 side, provided on the rear portion side of an oil pan arranged below the cylinder block 2.

A ring-shaped oil seal member 18 is arranged between an inner peripheral surface 16*a* of the bearing mounting portion 16 and an outer peripheral surface 4*b* of the crankshaft 4. This oil seal member 18 is fitted to the inner peripheral surface 16*a* side of the bearing mounting portion 16 and fixed to the main body side of the internal combustion engine. In this way, the bearing mounting portion 16 functions as an oil seal press-fitting portion or oil seal retainer. A seal lip 18*a* formed on the inner peripheral side of the oil seal 18 thus slidably contacts the outer peripheral surface 4*b* of the crankshaft 4, thereby providing an oil seal.

A bearing 14 is arranged between the side of the ring gear 10 that is opposite the side on which the one-way clutch 12 is arranged, i.e., the inner peripheral surface of the inner race 10*b*, and the main body of the internal combustion engine, as described above. Therefore, the ring gear 10 can rotate freely, independent of the crankshaft 4 when the one-way clutch 12 is released.

A gear portion 10*c* of the ring gear 10 is in constant mesh with a pinion gear of the starter motor at a phase position that is lower in the drawing than the crankshaft 4. The entire ring gear 10 is rotated by torque received from the starter motor via the pinion gear. Accordingly, the one-way clutch 12 engages the outer race support plate 8 with the ring gear 10 when the starter motor rotates the ring gear 10 via the pinion gear during startup of the internal combustion engine, i.e., when the ring gear 10 is rotated in the direction in which torque is transmitted from the ring gear 10 side to the outer race support plate 8 during startup of the internal combustion engine. As a result, the startup motor can rotate the crankshaft 4 via the ring gear 10, the one-way clutch 12, and the outer race support plate 8.

When the internal combustion engine starts to operate under its own power such that the crankshaft 4 rotates according to output of the internal combustion engine, the outer race support plate 8 which rotates in conjunction with the crankshaft 4 rotates faster than the ring gear 10 does from the starter motor. As a result, the ring gear 10 effectively rotates in the opposite direction relative to the outer race support plate 8 so the one-way clutch 12 releases. Therefore, even if the pinion gear and the ring gear 10 are in a state of constant mesh, overspeed of the starter motor after startup of the internal combustion engine can be prevented.

In this case, engine oil flows through oil passages in the cylinder block 2 or the crankshaft 4, as shown by the arrow A in the drawing. Oil is prevented from leaking out from the main body side of the internal combustion engine, however, because the oil seal member 18 is arranged between the inner peripheral surface 16*a* of the bearing mounting portion 16 and the outer peripheral surface 4*b* of the crankshaft 4.

The one-way clutch 12 and the bearing 14 are structured such neither requires a supply of lubrication oil (i.e., they are grease-filled in this embodiment). Therefore, the oil seal member 18 can be arranged farther toward the main body side of the internal combustion engine than the one-way clutch 12 and the bearing 14 and pose no problem with respect to lubrication of those parts.

The first embodiment described above can achieve the following effects.

(I) Oil in the main body of the internal combustion engine is prevented from leaking out because the oil seal member 18 is arranged between the bearing mounting portion 16, which is on the main body side of the internal combustion engine, and the crankshaft 4. Moreover, the one-way clutch 12 and the bearing 14 do not need to be supplied with lubrication oil because they are both grease filled, as described above. As a result, even if engine oil is prevented from flowing to the bearing 14 and the one-way clutch 12 by the oil sealing function of the oil seal member 18, it does not cause a problem with lubrication of either the one-way clutch 12 or the bearing 14.

As illustrated in FIG. 1, the oil seal member 18 need only provide a seal between the main body side of the internal combustion engine and the crankshaft 4, which means that the oil seal member 18 can have a small diameter that fits closely to the crankshaft 4, i.e., the oil seal member 18 does not have to have a large diameter. Therefore, even when the crankshaft 4 rotates while the internal combustion engine is operating, the small diameter oil seal member 18 will not slide at a high rate of speed against the outer peripheral surface 4*b* of the crankshaft 4. As a result, the oil seal member 18 will not degrade quickly.

(II) The inner race 10*b* of the one-way clutch 12 is part of the ring gear 10 and the outer race 8*a* of the one-way clutch 12 is part of the outer race support plate 8. Therefore, the outer race support plate 8 which is a crankshaft side member can cover the portions where the one-way clutch 12, the bearing 14, and the oil seal member 18 are arranged. As a result, lubrication oil is not supplied and foreign matter from the outside is inhibited from getting into the one-way clutch 12 and the bearing 14 which are not sealed off from the outside by a seal member. Furthermore, foreign matter is prevented from wearing away the oil seal member 18, thus enabling good oil sealability to be maintained.

(III) The bearing 14 which is arranged between the ring gear 10 and the bearing mounting portion 16 need only function as a roller bearing only during startup because the ring gear 10 does not rotate while the internal combustion engine is operating after startup. Accordingly, the maximum peripheral velocity of the bearing 14 is reduced, thereby improving reliability.

(IV) The one-way clutch 12, the bearing 14, and the oil seal member 18 are radially arranged in the same position in the axial direction. As a result, the startup torque transmitting mechanism of an internal combustion engine can be made shorter in the axial direction, thereby contributing to a smaller internal combustion engine.

(V) The one-way clutch 12 is arranged farthest to the outside in the radial direction, which allows the internal structure of the one-way clutch 12, in this case, multiple sprags, to be arranged in a sufficiently long peripheral portion of the one-way clutch 12. As a result, the widths of the sprags do not need to be extended in the axial direction. This also enables to the startup torque transmitting mechanism of an internal combustion engine to be made shorter in the axial direction, thereby contributing to a smaller internal combustion engine.

In this specification, the inner peripheral side or the inner peripheral surface refers to the side or surface facing (i.e., closest to) the crankshaft. Conversely, the outer peripheral side or the outer peripheral surface refers to the side or surface farthest from the crankshaft.

Second Embodiment

Figure 2:
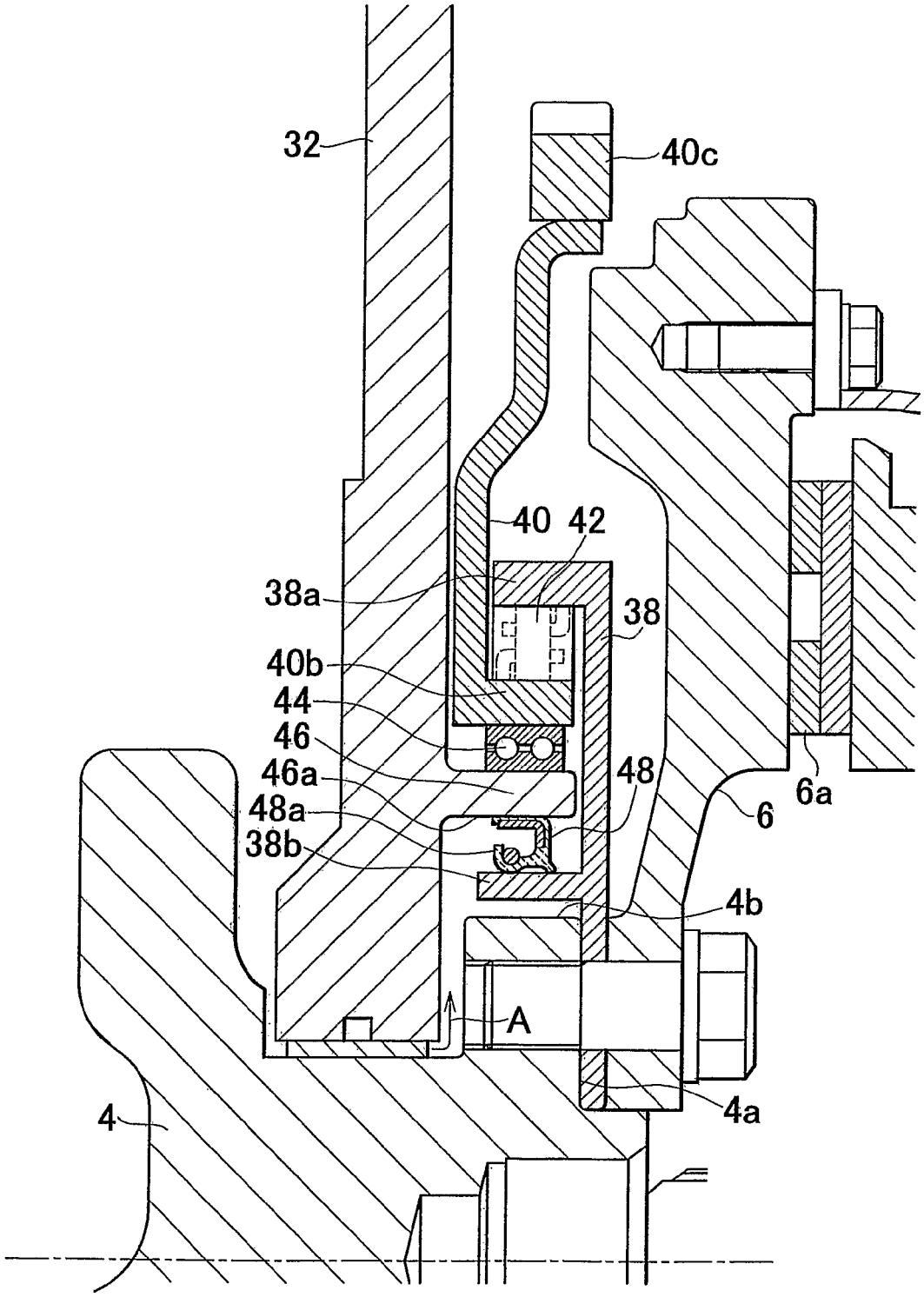
FIG. 2 is a longitudinal sectional view of a startup torque transmitting mechanism of an internal combustion engine according to a second embodiment of the invention.

A startup torque transmitting mechanism of an internal combustion engine according to a second embodiment of the invention is shown in the longitudinal sectional view in FIG. 2. In this embodiment, the structures of the crankshaft 4 and the flywheel 6 are the same as they are in the startup torque transmitting mechanism of an internal combustion engine according to a first embodiment (FIG. 1) and will therefore be denoted by the same reference numerals. Also, a cylinder block 32, a ring gear 40, a grease-filled one-way clutch 42, a grease-filled bearing 44, and an oil seal member 48 are also basically the same shapes as they are in the first embodiment, although their respective arrangements and diameters are different.

The second embodiment differs from the first embodiment in that a seal sliding portion 38*b* is formed in a short cylindrical shape farther toward the radial center than an outer race 38*a* of the one-way clutch 42 on an outer race support plate 38. The oil seal member 48 is similar to the oil seal member in the first embodiment in that it is fitted to an inner peripheral surface 46*a* of a bearing mounting portion 46 formed on the cylinder block 32, but differs from the oil seal member of the first embodiment in that a seal lip 48*a* on the inner peripheral side slidably contacts the seal sliding portion 38*b*.

As a result, when the crankshaft 4 rotates, the oil seal member 48 slides against the outer race support plate 38, thus providing an oil seal.

The second embodiment is also similar to the first embodiment in that the one-way clutch 42 is formed between the outer race 38*a*, which is formed on the outer race support plate 38, and an inner race 40*b* of the ring gear 40, and the bearing 44 is arranged on the inner peripheral side of that inner race 40*b*.

The second embodiment described above can achieve the following effects.

(I) Oil in the main body of the internal combustion engine is prevented from leaking out because the oil seal member 48 is arranged between the bearing mounting portion 46, which is part of the main body of the internal combustion engine, and the outer race support plate 38 which is a crankshaft side member. Moreover, the one-way clutch 42 and the bearing 44 do not need to be supplied with lubrication oil because they are both grease filled, as described above. As a result, even if engine oil is prevented from flowing to the bearing 44 and the one-way clutch 42 by the oil sealing function of the oil seal member 48, it does not cause a problem with lubrication of either the one-way clutch 42 or the bearing 44.

As illustrated in FIG. 2, the oil seal member 48 need only provide a seal between the cylinder block 32 and the seal sliding portion 38*b* which is closest to the radial center after the crankshaft 4, which means the oil seal member 48 is arranged in a position close to the radial center and therefore has a small diameter. Thus, because the oil seal member 48 does not have a large diameter, it will not slide at a high rate of speed against the seal sliding portion 38*b* even if the outer race support plate 38 rotates together with the crankshaft 4 while the internal combustion engine is operating. As a result, the oil seal member 48 will not degrade quickly.

(II) The same effects described in (II) to (V) in the first embodiment can be achieved.

(III) The radial position of the seal sliding portion 38*b* can be adjusted to achieve the appropriate circumference of each portion, particularly the one-way clutch 42, of the startup torque transmitting mechanism of an internal combustion engine. As a result, the appropriate number of sprags and appropriate sprag widths can be selected, thus making it easier to design the startup torque transmitting mechanism of an internal combustion engine.

Third Embodiment

Figure 3:
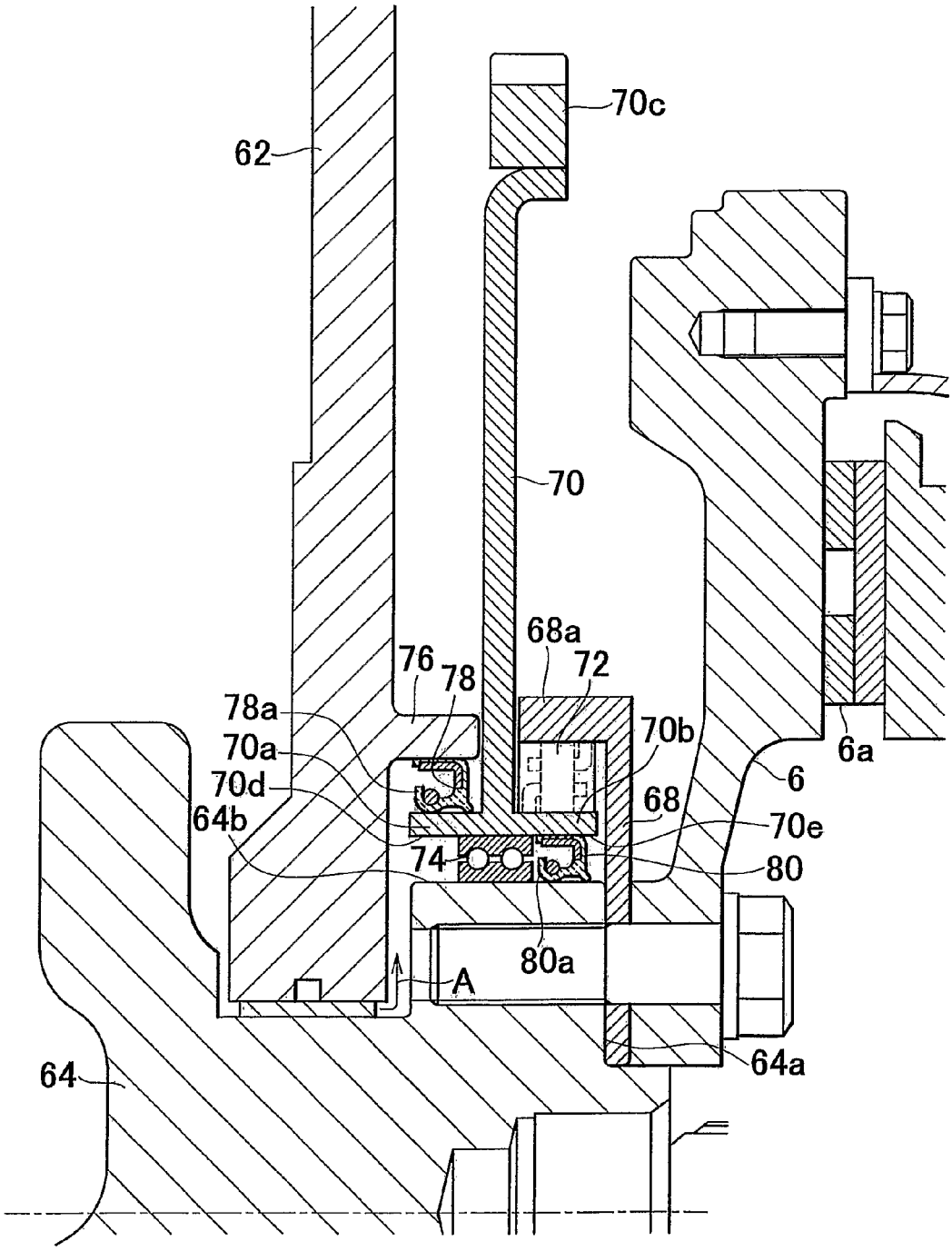
FIG. 3 is a longitudinal sectional view of a startup torque transmitting mechanism of an internal combustion engine according to a third embodiment of the invention.

A startup torque transmitting mechanism of an internal combustion engine according to a third embodiment of the invention is shown in the longitudinal sectional view in FIG. 3. In this embodiment, the structure of the flywheel 6 is the same as it is in the startup torque transmitting mechanism of an internal combustion engine according to the first embodiment (FIG. 1) and will therefore be denoted by the same reference numeral. Also, a cylinder block 62, a crankshaft 64, an outer race support plate 68, a one-way clutch 72, and a bearing 74 are also basically the same shapes as they are in the first embodiment, although their respective arrangements and diameters are different.

The third embodiment differs from the first embodiment in that the oil seal member includes two members: an outer oil seal member 78 (which can be regarded as a second oil seal member in the claims) and an inner oil seal member 80 (which can be regarded as a first oil seal member in the claims). The oil seal members 78 and 80 are basically the same shapes as the oil seal member in the first embodiment, although their respective arrangements and diameters are different.

The third embodiment also differs from the first embodiment in that a seal sliding portion 70*a* which protrudes in a short cylindrical shape toward a cylinder block 62 side is formed on an inner peripheral portion of a ring gear 70, and an inner race 70*b* of a one-way clutch 72 which protrudes in a short cylindrical shape away from the cylinder block 62 is also formed on the inner peripheral portion of the ring gear 70. In this embodiment, an inner peripheral surface 70*d* of the seal sliding portion 70*a* and an inner peripheral surface 70*e* of the inner race 70*b* both have the same diameter and form a continuous inner peripheral surface. A bearing 74 for rotatably supporting the ring gear 70 on the crankshaft 64 is arranged between the inner peripheral surfaces 70*d* and 70*e* and an outer peripheral surface 64*b* of the crankshaft 64. Accordingly, the portion that protrudes in a short cylindrical shape from the cylinder block 62 and oil pan functions as an oil seal mounting portion 76 for fitting the outer oil seal member 78.

An inner oil seal member 80 is also arranged parallel with the bearing 74 between the inner peripheral surfaces 70*d* and 70*e* and the outer peripheral surface 64*b*. This inner oil seal member 80 is fitted to the inner peripheral surface 70*e*. An inner peripheral side seal lip 80*a* slidably contacts the outer peripheral surface 64*b* of the crankshaft 64. As a result, oil is prevented from leaking out from the bearing 74 side.

The third embodiment described above can achieve the following effects.

(I) Oil in the main body of the internal combustion engine is prevented from leaking out because the two oil seal members 78 and 80 are provided, as shown in the drawing. Moreover, the bearing 74 is arranged farther toward the main body side of the internal combustion engine than the inner oil seal member 80 so it can be lubricated with engine oil supplied from within the main body of the internal combustion engine. The one-way clutch 72 does not need to be supplied with lubrication oil because it is grease filled. Therefore, the one-way clutch 72 can be arranged farther toward the outside than the inner oil seal member 80 without causing problems in terms of lubrication of the one-way clutch 72.

Moreover, because the ring gear 70 does not rotate with respect to the cylinder block 62 while the internal combustion engine is operating after startup and the outer oil seal member 78 is arranged between the ring gear 70 and the cylinder block 62, the outer oil seal member 78 will not slide while the internal combustion engine is operating so it can have a large diameter without degrading quickly as a result.

Accordingly, the oil seal members 78 or 80 do not slide at a high rate of speed or slide at all while the internal combustion engine is operating so neither will degrade quickly.

(II) The inner race 70*b* of the one-way clutch 72 is part of the ring gear 70 and the outer race 68*a* of the one-way clutch 72 is part of the outer race support plate 68. Therefore, the outer race support plate 68 which is a crankshaft side member can cover the portions where the one-way clutch 72, the bearing 74, and the inner oil seal member 80 are arranged. As a result, in particular, lubrication oil is not supplied and foreign matter from the outside is inhibited from getting into the one-way clutch 72 which is not sealed off from the outside by a seal member. Furthermore, foreign matter is prevented from wearing away the inner oil seal member 80, thus enabling good oil sealability to be maintained.

(III) The bearing 74 which is arranged between the ring gear 70 and the crankshaft 64 is farthest toward the inner peripheral side so its peripheral velocity is reduced, thereby improving reliability.

Fourth Embodiment

Figure 4:
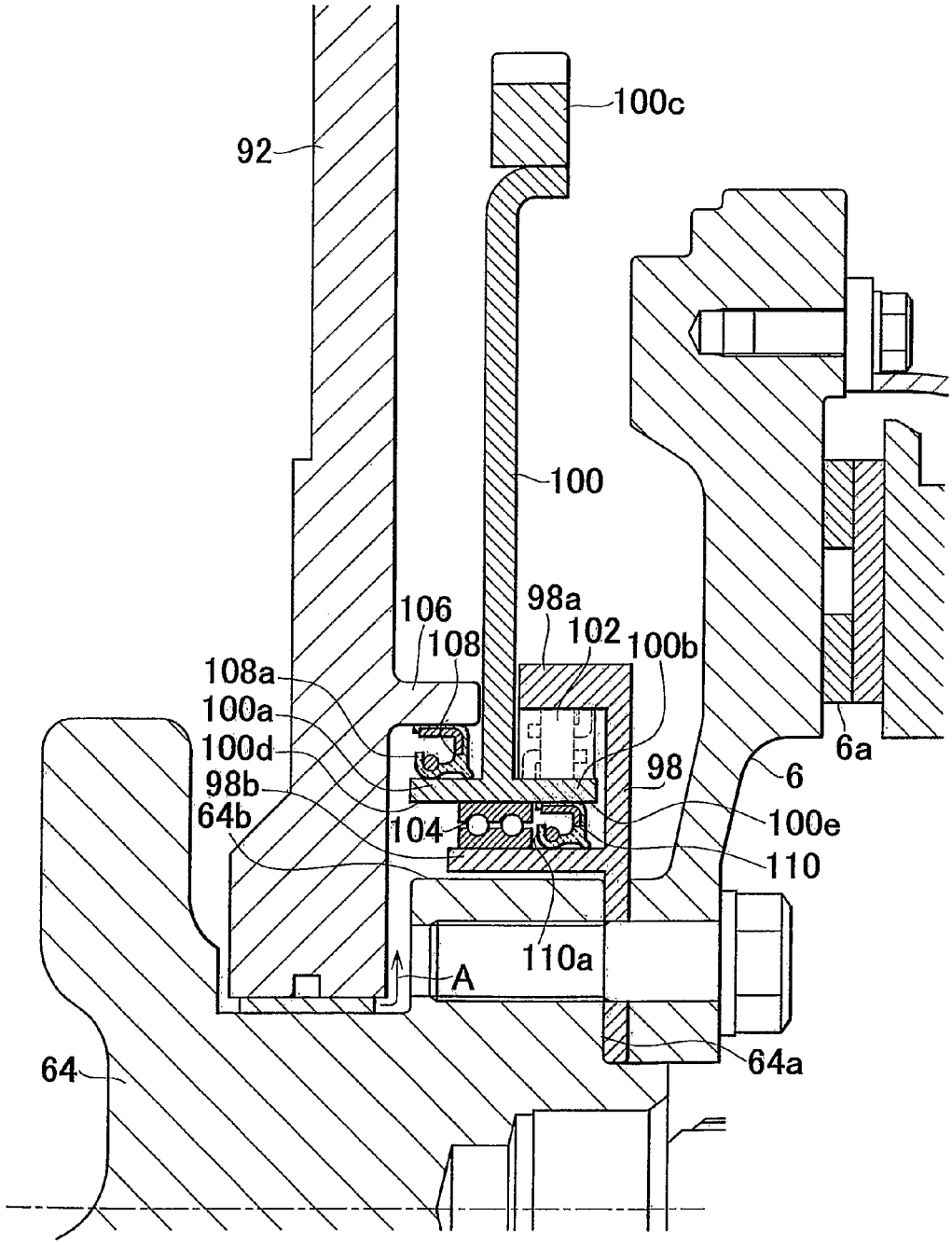
FIG. 4 is a longitudinal sectional view of a startup torque transmitting mechanism of an internal combustion engine according to a fourth embodiment of the invention.

A startup torque transmitting mechanism of an internal combustion engine according to a fourth embodiment of the invention is shown in the longitudinal sectional view in FIG. 4. In this embodiment, the structures of the flywheel 6 and the crankshaft 64 are the same as they are in the startup torque transmitting mechanism of an internal combustion engine according to the third embodiment (FIG. 3) so will therefore be denoted by the same reference numerals. Also, a cylinder block 92, a ring gear 100, a one-way clutch 102, a bearing 104, and two oil seal members 108 and 110 are also basically the same shapes as they are in the third embodiment, although their respective arrangements and diameters are different.

The fourth embodiment differs from the third embodiment in that a ring gear support portion 98*b* is formed in a short cylindrical shape farther toward the radial center than an outer race 98*a* of the one-way clutch 102 on an outer race support plate 98. An inner oil seal member 110 is similar to the oil seal member in the third embodiment in that it is fitted to an inner peripheral surface 100*e* of an inner race 100*b* of the one-way clutch 102, but differs from the oil seal member of the third embodiment in that a seal lip 110*a* on the inner peripheral side slidably contacts the ring gear support portion 98*b*. Further, a bearing 104 is arranged between the ring gear 100 and the ring gear support portion 98*b*. This bearing 104 rotatably supports the ring gear 100 with respect to the outer race support plate 98.

Accordingly, when the crankshaft 64 rotates after startup of the internal combustion engine, the inner oil seal member 110 slides against the ring gear support portion 98*b*, thereby providing an oil seal.

The fourth embodiment is also similar to the third embodiment in that the one-way clutch 102 is arranged between the outer race 98*a* which is part of the outer race support plate 98 and the inner race 100*b* which is part of the ring gear 100, and the outer oil seal member 108 is arranged between the oil seal mounting portion 106 and the seal sliding portion 100*a*.

The fourth embodiment described above can achieve the following effects.

(I) Although the ring gear support portion 98*b* is lifted up slightly in the radial direction, the same effects obtained by the third embodiment can also be obtained by this embodiment.

(II) The radial position of the ring gear support portion 98*b* can be adjusted to achieve the appropriate circumference of each portion, particularly the one-way clutch 102, of the startup torque transmitting mechanism of an internal combustion engine. As a result, the appropriate number of sprags and appropriate sprag widths can be selected, thus making it easier to design the startup torque transmitting mechanism of an internal combustion engine. In particular, if there are not enough sprags in the one-way clutch 102, the circumference of the one-way clutch 102 can be lengthened by lifting the ring gear 100 farther toward the outer peripheral side by the ring gear support portion 98*b*, thus enabling the number of sprags to be increased. Increasing the number of sprags in this way enables the widths of the sprags to be shortened in the axial direction. As a result, the startup torque transmitting mechanism of an internal combustion engine can be made shorter in the axial direction, thereby contributing to a smaller internal combustion engine.

Fifth Embodiment

Figure 5:
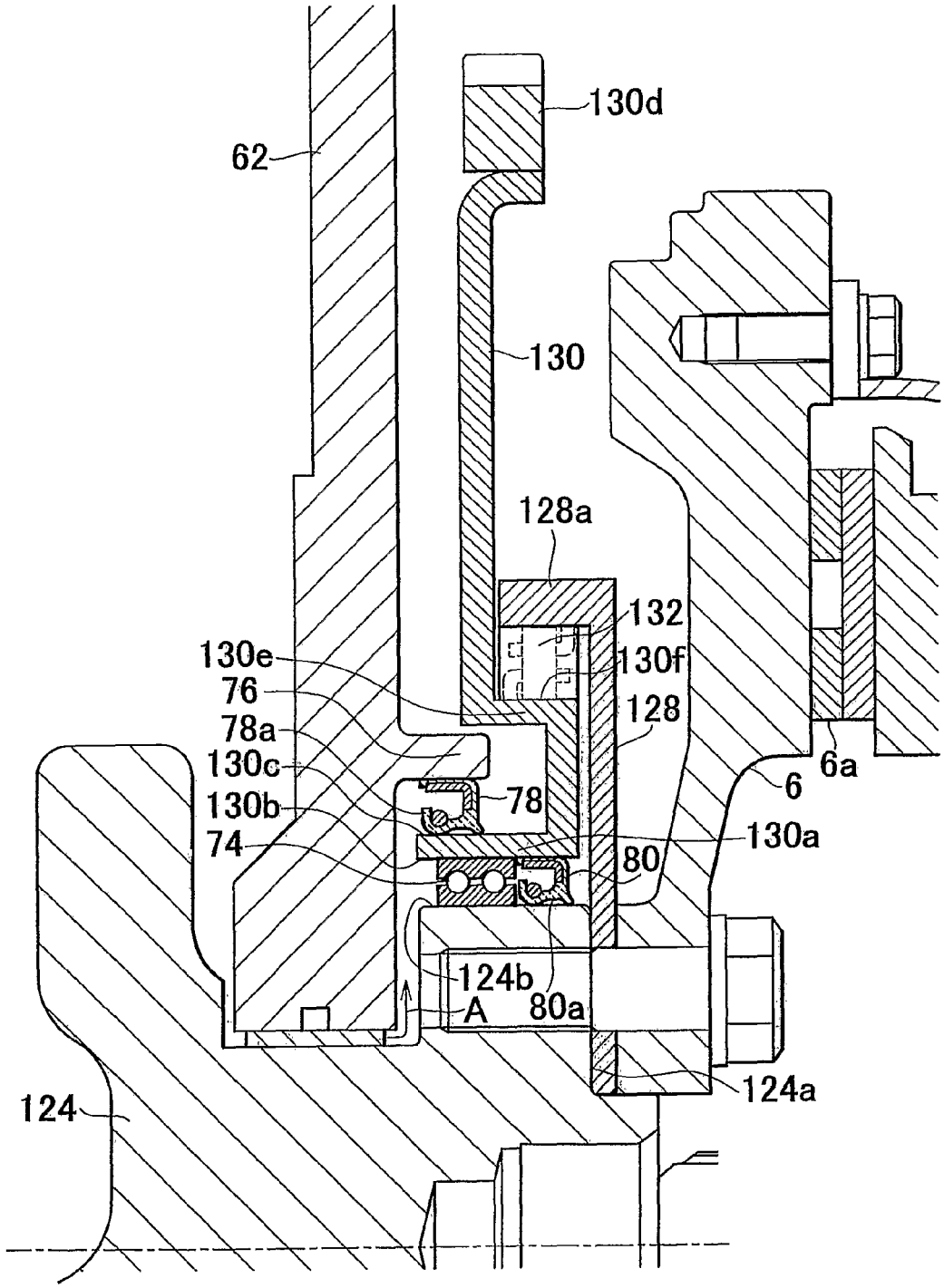
FIG. 5 is a longitudinal sectional view of a startup torque transmitting mechanism of an internal combustion engine according to a fifth embodiment of the invention.

A startup torque transmitting mechanism of an internal combustion engine according to a fifth embodiment of the invention is shown in the longitudinal sectional view in FIG. 5. In this embodiment, the structures of the flywheel 6, the cylinder block 62, the bearing 74, and the oil seal members 78 and 80 are the same as they are in the startup torque transmitting mechanism of an internal combustion engine according to the third embodiment (FIG. 3) so will therefore be denoted by the same reference numerals. Also, a crankshaft 124, an outer race support plate 128, and a grease-filled one-way clutch 132 are also basically the same shapes as they are in the third embodiment, although their respective arrangements and diameters are different.

The fifth embodiment differs from the third embodiment in that a short cylindrical portion 130*a* which protrudes on the cylinder block 62 side is formed on an inner peripheral portion of a ring gear 130. Also, the bearing 74 is arranged between an inner peripheral surface 130*b* side of that short cylindrical portion 130*a* and an outer peripheral surface 124*b* of the crankshaft 124. The ring gear 130 is rotatably supported by the crankshaft 124 via this bearing 74. Moreover, an inner oil seal member 80 is fitted parallel with the bearing 74 to the inner peripheral surface 130*b* of the short cylindrical portion 130*a*, and a seal lip 80*a* slidably contacts the outer peripheral surface 124*b* of the crankshaft 124 such that an oil seal is formed between the ring gear 130 and the crankshaft 124.

An outer oil seal member 78 is arranged fitted to the oil seal mounting portion 76 between the outer peripheral surface 130*c* of the short cylindrical portion 130*a* and the oil seal mounting portion 76. A seal lip 78*a* of this outer oil seal member 78 slidably contacts the outer peripheral surface 130*c* of the short cylindrical portion 130*a* such that an oil seal is formed between the cylinder block 62 and the ring gear 130.

A mid short cylindrical portion 130*e* is formed in the ring gear 130 by having the ring gear 130 be bent between the inner peripheral side short cylindrical portion 130*a* and an outer peripheral side gear portion 130*d*. This mid short cylindrical portion 130*e* is formed as an inner race of the one-way clutch 132. As a result, the one-way clutch 132 is arranged between an outer peripheral surface 130*f* side of this mid short cylindrical portion 130*e* and the outer race 128*a* formed on the outer peripheral side of the outer race support plate 128.

The fifth embodiment described above can achieve the following effects.

(I) Although the surface on the one-way clutch 132 side (i.e., the outer peripheral surface 130*f* side) and the inner peripheral surface 130*b* of the short cylindrical portion 130*a*, which is the surface facing the opposite direction from that surface, are opposite surfaces (i.e., front-back surfaces) of the same portion in the third embodiment whereas in the fifth embodiment they are not (i.e., in the fifth embodiment the outer peripheral surface 130*f* side is separated from the inner peripheral surface 130*b* side in the radial direction on the ring gear 130), the same effects obtained in the third embodiment can also be obtained in this embodiment.

(II) With the ring gear 130 in this embodiment, the mid short cylindrical portion 130*e* is formed as an inner race of the one-way clutch 132 farther to the outside than the inner peripheral side short cylindrical portion 130*a*. Because this mid short cylindrical portion 130*e* can be separated from the short cylindrical portion 130*a*, there is a large degree of freedom in design with respect to arrangement in the radial direction. Therefore, by arranging the mid short cylindrical portion 130*e* far enough to the outer peripheral side, for example, the inner structure of the one-way clutch 132, in this case a large number of sprags, can be arranged without lengthening the circumference of the bearing 74 and the oil seal members 78 and 80. Therefore, an increase in sprag width can be suppressed which makes it possible to reduce the length of the startup torque transmitting mechanism of an internal combustion engine in the axial direction, in turn contributing to a smaller internal combustion engine. In this way, adjustments such as narrowing the width in the axial direction of the one-way clutch 132 or increasing the capacity of the one-way clutch 132 can be easily done without affecting the other structure.

Sixth Embodiment

Figure 6:
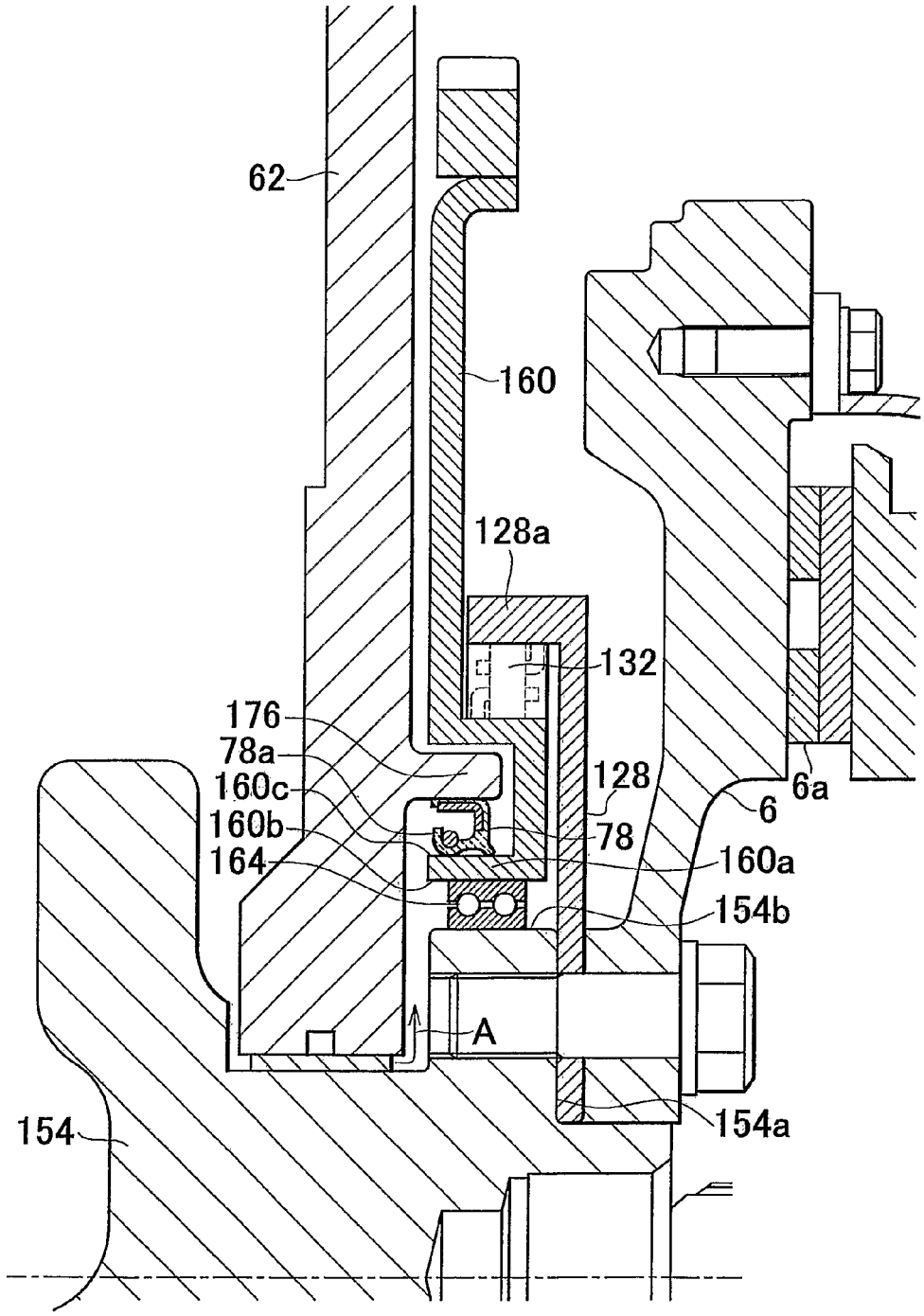
FIG. 6 is a longitudinal sectional view of a startup torque transmitting mechanism of an internal combustion engine according to a sixth embodiment of the invention.

A startup torque transmitting mechanism of an internal combustion engine according to a sixth embodiment of the invention is shown in the longitudinal sectional view in FIG. 6. In this embodiment, the structures of the flywheel 6, the cylinder block 62, the outer oil seal member 78, the outer race support plate 128, and the grease-filled one-way clutch 132 are the same as they are in the startup torque transmitting mechanism of an internal combustion engine according to the fifth embodiment (FIG. 5) so will therefore be denoted by the same reference numerals. Also, a crankshaft 154 and a ring gear 160 are also basically the same shapes as they are in the fifth embodiment, although their respective arrangements and diameters are different.

The sixth embodiment differs from the fifth embodiment in that a bearing 164 is arranged between a short cylindrical portion 160*a* on the inner peripheral side of the ring gear 160 and an outer peripheral surface 154*b* of the crankshaft 154, and there is no inner oil seal member. Also, this bearing 164 has an integrated oil seal and receives a supply of engine oil from the cylinder block 62 side while the internal oil seal prevents oil from leaking to the outside from the bearing 164.

The sixth embodiment described above can achieve the following effects.

(I) Although there is only one oil seal member 78, the same effects obtained by the fifth embodiment can also be obtained by this embodiment because the bearing 164 has an integrated oil seal.

(II) In the startup torque transmitting mechanism of an internal combustion engine according to this embodiment, only the bearing 164 need be provided between the ring gear 160 and the crankshaft 154, i.e., no oil seal member need be provided there. Also, the one-way clutch 132, the oil seal member 78, and the bearing 164 are radially arranged in substantially the same position in the axial direction, which enables the length of the startup torque transmitting mechanism of an internal combustion engine to be reduced in the axial direction, thereby contributing to a smaller internal combustion engine.

Seventh Embodiment

Figure 7:
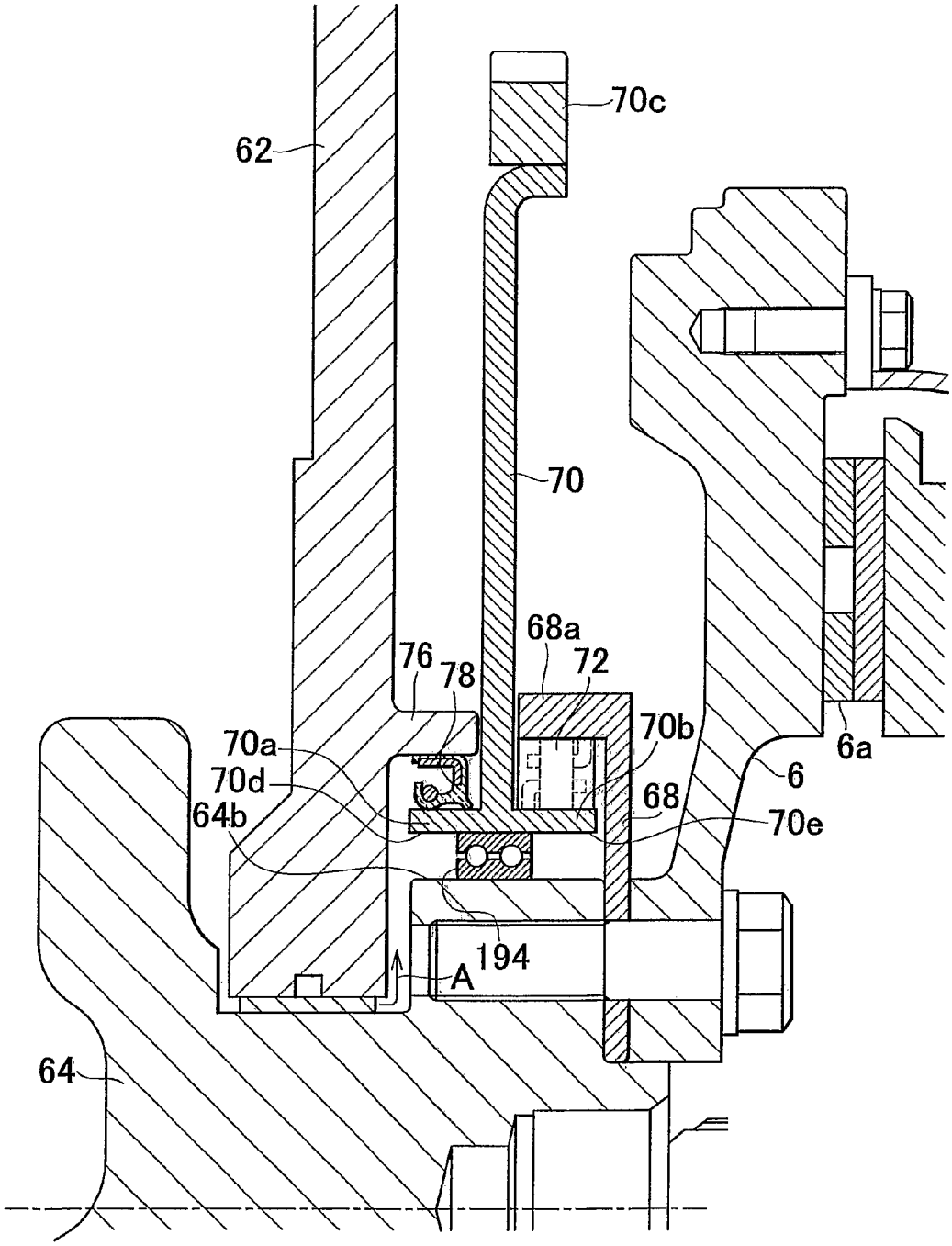
FIG. 7 is a longitudinal sectional view of a startup torque transmitting mechanism of an internal combustion engine according to a seventh embodiment of the invention.

A startup torque transmitting mechanism of an internal combustion engine according to a seventh embodiment of the invention is shown in the longitudinal sectional view in FIG. 7. In this embodiment, only the structure between the ring gear 70 and the crankshaft 64 differs from the structure in the third embodiment (FIG. 3); all other structures are the same and will thus be denoted by the same reference numerals as they are in the third embodiment.

With this structure, no oil seal member is provided between the ring gear 70 and the crankshaft 64. Instead, a bearing 194 with an integrated oil seal is arranged there. Accordingly, even if engine oil from the cylinder block 62 side is supplied to this bearing 194 with an integrated oil seal, that engine oil enters the bearing 194 but is prevented from passing through it so no engine oil will leak out to the grease-filled one-way clutch 72 side.

The seventh embodiment described above can achieve the following effects.

(I) The same effects obtained by the third embodiment are also obtained by this embodiment.

(II) The work of attaching the oil seal member between the ring gear 70 and the crankshaft 64 is not necessary so assembly of the startup torque transmitting mechanism of an internal combustion engine is simpler than it is with the third embodiment.

Eighth Embodiment

Figure 8:
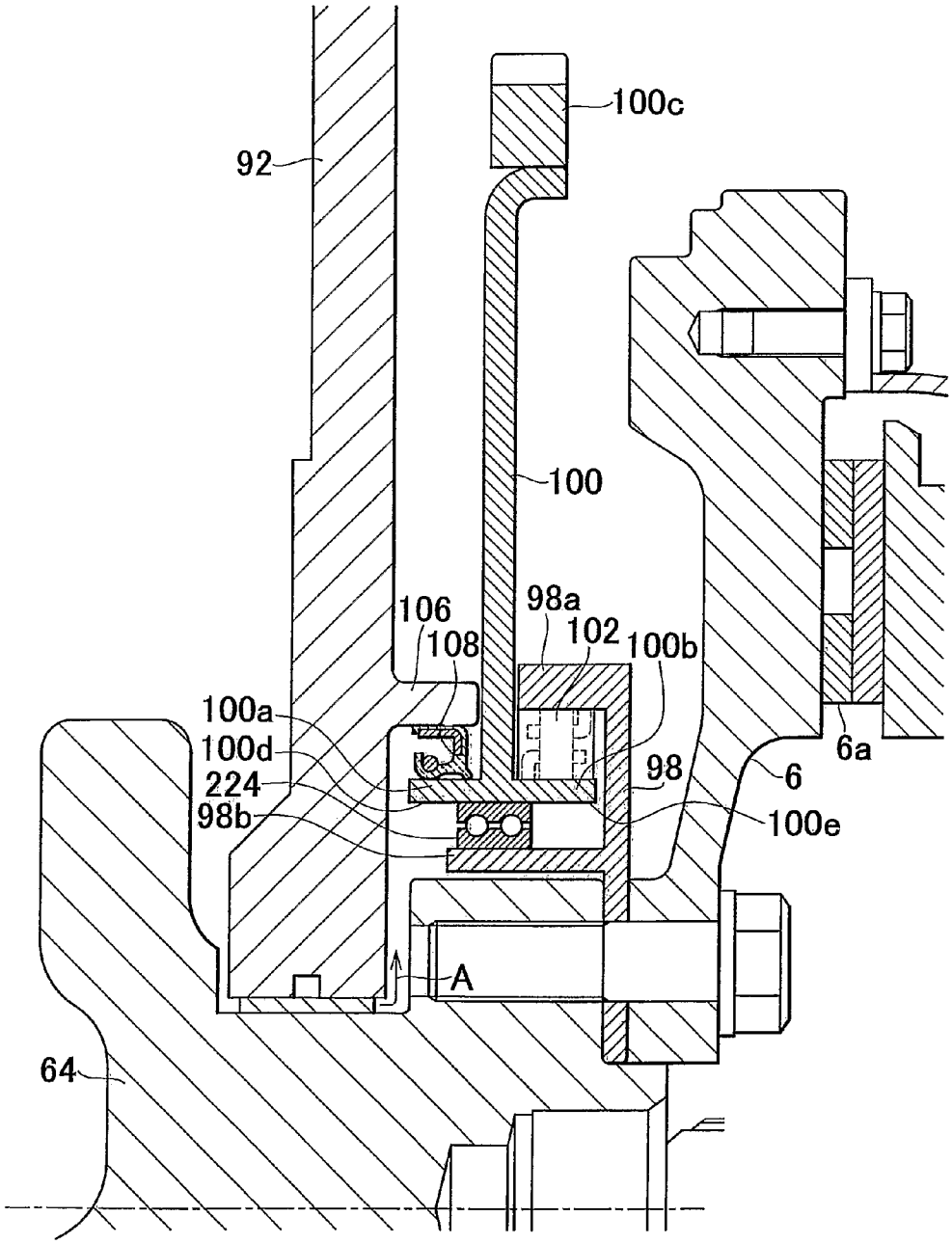
FIG. 8 is a longitudinal sectional view of a startup torque transmitting mechanism of an internal combustion engine according to an eighth embodiment of the invention.

A startup torque transmitting mechanism of an internal combustion engine according to an eighth embodiment of the invention is shown in the longitudinal sectional view in FIG. 8. In this embodiment, only the structure between the ring gear 100 and the ring gear support portion 98*b* of the outer race support plate 98 differs from the structure in the fourth embodiment (FIG. 4); all other structures are the same and will thus be denoted by the same reference numerals as they are in the fourth embodiment.

With this structure, no oil seal member is provided between the ring gear 100 and the ring gear support portion 98*b*. Instead, a bearing 224 with an integrated oil seal is arranged there. Accordingly, even if engine oil from the cylinder block 92 side is supplied to this bearing 224 with an integrated oil seal, that engine oil enters the bearing 224 but is prevented from passing through it so no engine oil will leak out to the grease-filled one-way clutch 102 side.

The eighth embodiment described above can achieve the following effects.

(I) The same effects obtained by the fourth embodiment are also obtained by this embodiment.

(II) The work of attaching the oil seal member between the ring gear 100 and the ring gear support portion 98*b* is not necessary so assembly of the startup torque transmitting mechanism of an internal combustion engine is simpler than it is with the fourth embodiment.

Ninth Embodiment

Figure 9:
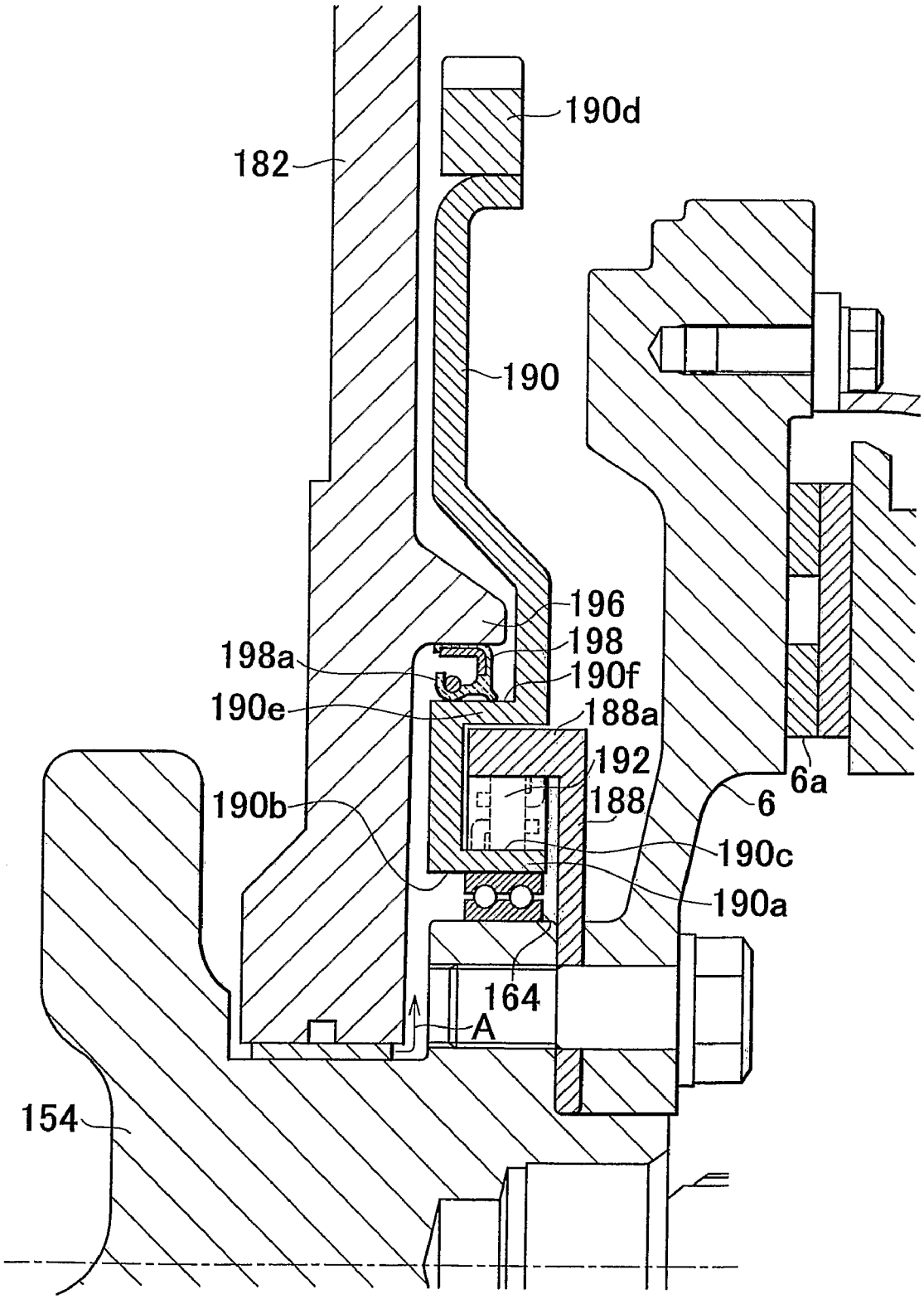
FIG. 9 is a longitudinal sectional view of a startup torque transmitting mechanism of an internal combustion engine according to a ninth embodiment of the invention.

A startup torque transmitting mechanism of an internal combustion engine according to a ninth embodiment of the invention is shown in the longitudinal sectional view in FIG. 9. In this embodiment, the structures of the crankshaft 154 and the bearing 164 are the same as those in the startup torque transmitting mechanism of an internal combustion engine according to the sixth embodiment (FIG. 6) and so will be denoted by the same reference numerals. Also, the structures of a cylinder block 182, an outer race support plate 188, a ring gear 190, a one-way clutch 192, and an oil seal member 198 are also basically the same shapes as they are in the sixth embodiment, although their respective arrangements and diameters are different.

The ninth embodiment differs from the sixth embodiment in terms of the relationship between the outer race support plate 188 and the ring gear 190, but is similar to the sixth embodiment in that the bearing 164 is arranged between a short cylindrical portion 190*a* of the ring gear 190 and the crankshaft 154.

The one-way clutch 192 is arranged between an outer race 188*a* of the outer race support plate 188 and the side of the short cylindrical portion 190*a* of the ring gear 190 that is opposite the inner peripheral surface 190*b* side where the bearing 164 is arranged.

The oil seal member 198 is arranged between an oil seal mounting portion 196 on the cylinder block 182 side and a mid short cylindrical portion 190*e* which is formed midway between the inner peripheral side short cylindrical portion 190*a* and an outer peripheral side gear portion 190*d*, and bent at the outer peripheral side of the outer race 188*a* of the outer race support plate 188. This oil seal member 198 is fixed in place by being fitted to the oil seal mounting portion 196 such that a seal lip 198*a* on the inner peripheral side slidably abuts against an outer peripheral surface 190*f* of the mid short cylindrical portion 190*e* thereby forming an oil seal.

The ninth embodiment described above can achieve the following effects.

(I) The oil seal member 198 is arranged between the cylinder block 182 and the ring gear 190 and the bearing 164 having an integrated oil seal is arranged between the crankshaft 154 and the ring gear 190. As a result, the bearing 164 can be lubricated with engine oil from the main body side of the internal combustion engine and that engine oil is prevented from leaking to the outside. Also, the one-way clutch 192 is grease-filled and so does not require a supply of lubrication oil so no lubrication problems arise if the one-way clutch 192 is not on the internal combustion engine main body side of the bearing 164.

Moreover, because the ring gear 190 does not rotate with respect to the cylinder block 182 while the internal combustion engine is operating after startup and the oil seal member 198 is arranged between the ring gear 190 and the cylinder block 182, the oil seal member 198 will not slide while the internal combustion engine is operating so it can have a large diameter without degrading quickly as a result.

(II) The short cylindrical portion 190*a* as the inner race of the one-way clutch 192 is part of the ring gear 190 and the outer race 188*a* of the one-way clutch 192 is part of the outer race support plate 188. Therefore, the outer race support plate 188 which is a crankshaft side member can cover the portion where the one-way clutch 192 and the bearing 194 are arranged. As a result, in particular, no lubrication oil is supplied and foreign matter from the outside is inhibited from getting into the one-way clutch 192 which is not sealed off from the outside by a seal member.

(III) Only the bearing 164 need be provided between the ring gear 190 and the crankshaft 154, i.e., no oil seal member need be provided there. Also, the oil seal member 198, the one-way clutch 192, and the bearing 164 are radially arranged in substantially the same position in the axial direction, which enables the length of the startup torque transmitting mechanism of an internal combustion engine to be reduced in the axial direction, thereby contributing to a smaller internal combustion engine.

(IV) The bearing 164 which is arranged between the ring gear 190 and the crankshaft 154 is farthest toward the inner peripheral side in the radial direction so its peripheral velocity is reduced, thereby improving reliability.

Tenth Embodiment

Figure 10:
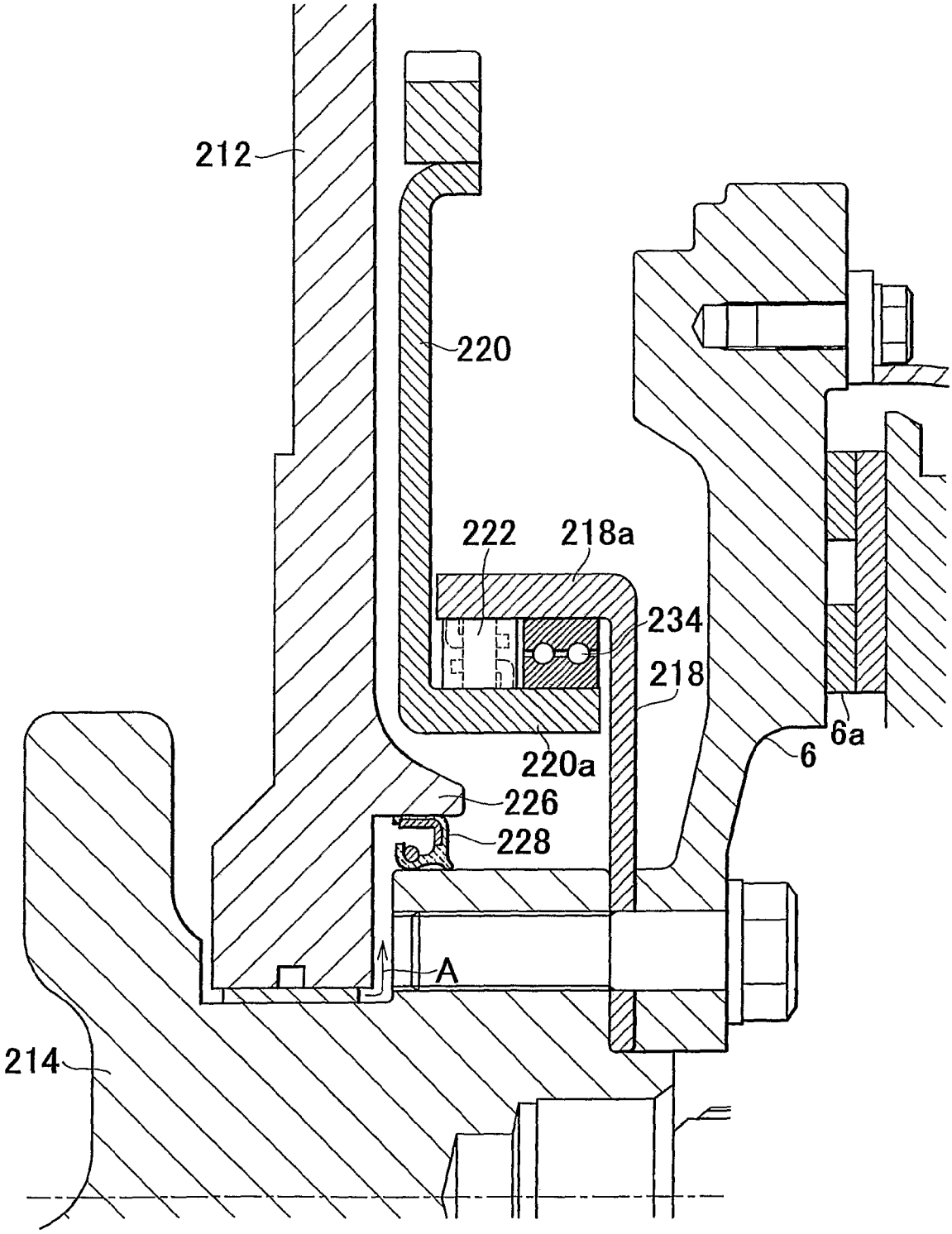
FIG. 10 is a longitudinal sectional view of a startup torque transmitting mechanism of an internal combustion engine according to a tenth embodiment of the invention.

A startup torque transmitting mechanism of an internal combustion engine according to a tenth embodiment of the invention is shown in the longitudinal sectional view in FIG. 10. In this embodiment, the structure of the flywheel 6 is the same as it is in the startup torque transmitting mechanism of an internal combustion engine according to the first embodiment (FIG. 1) and will therefore be denoted by the same reference numeral. Also, a cylinder block 212, a crankshaft 214, an outer race support plate 218, a ring gear 220, a grease-filled one-way clutch 222, and an oil seal member 228 are also basically the same shapes as they are in the first embodiment, although their respective arrangements and diameters are different.

The tenth embodiment differs from the first embodiment in that a grease-filled bearing 234 is arranged between an inner race 220*a* of a ring gear 220 and an outer race 218*a* of an outer race support plate 218 where the one-way clutch 222 is arranged. That is, the ring gear 220 is rotatably supported by only the outer race support plate 218.

The tenth embodiment described above can achieve the following effects.

(I) The grease-filled bearing 234 is arranged together with the grease-filled one-way clutch 222 between the ring gear 220 and the outer race support plate 218. Thus, because neither the bearing 234 nor the one-way clutch 222 needs to be supplied with lubrication oil, no problems occur with lubrication of the bearing 234 and the one-way clutch 222 due to that arrangement.

Further, the oil seal member 228 is arranged between the cylinder block 212 on the main body side of the internal combustion engine and the crankshaft 214. Therefore, engine oil will not leak out and the oil seal member 228 does not have to have a large diameter. As a result, the oil seal member 228 does not slide at a high rate of speed while the crankshaft 214 is rotating and thus will not degrade quickly.

(II) The inner race 220*a* for the one-way clutch 222 is formed on the ring gear 220 and the outer race 218*a* for the one-way clutch 222 is formed on the outer race support plate 218. The bearing 234 is arranged between the inner race 220*a* and the outer race 218*a*. That is, the one-way clutch 222 and the bearing 234 are covered by being sandwiched between the outer race support plate 218 and the ring gear 220. As a result, in particular, no lubrication oil is supplied and foreign matter from the outside is inhibited from getting into the bearing 234 and the one-way clutch 222 which are not sealed off from the outside by a seal member.

(III) The one-way clutch 222 and the bearing 234 are arranged independently from the oil seal member 228 so their positions can be changed in the radial direction without affecting the circumference of the oil seal member 228. As a result, there is a large degree of freedom in design with respect to the positioning of the one-way clutch 222 and the bearing 234 in the radial direction. Thus, by arranging them far enough to the outside, the inner structure, in this case a large number of sprags, can be arranged at the circumferential portion which is sufficiently long. Therefore, in particular, the widths of the sprags can be narrow so the startup torque transmitting mechanism of an internal combustion engine can be shorter in the axial direction, thus contributing to a smaller internal combustion engine.

Eleventh Embodiment

Figure 11:
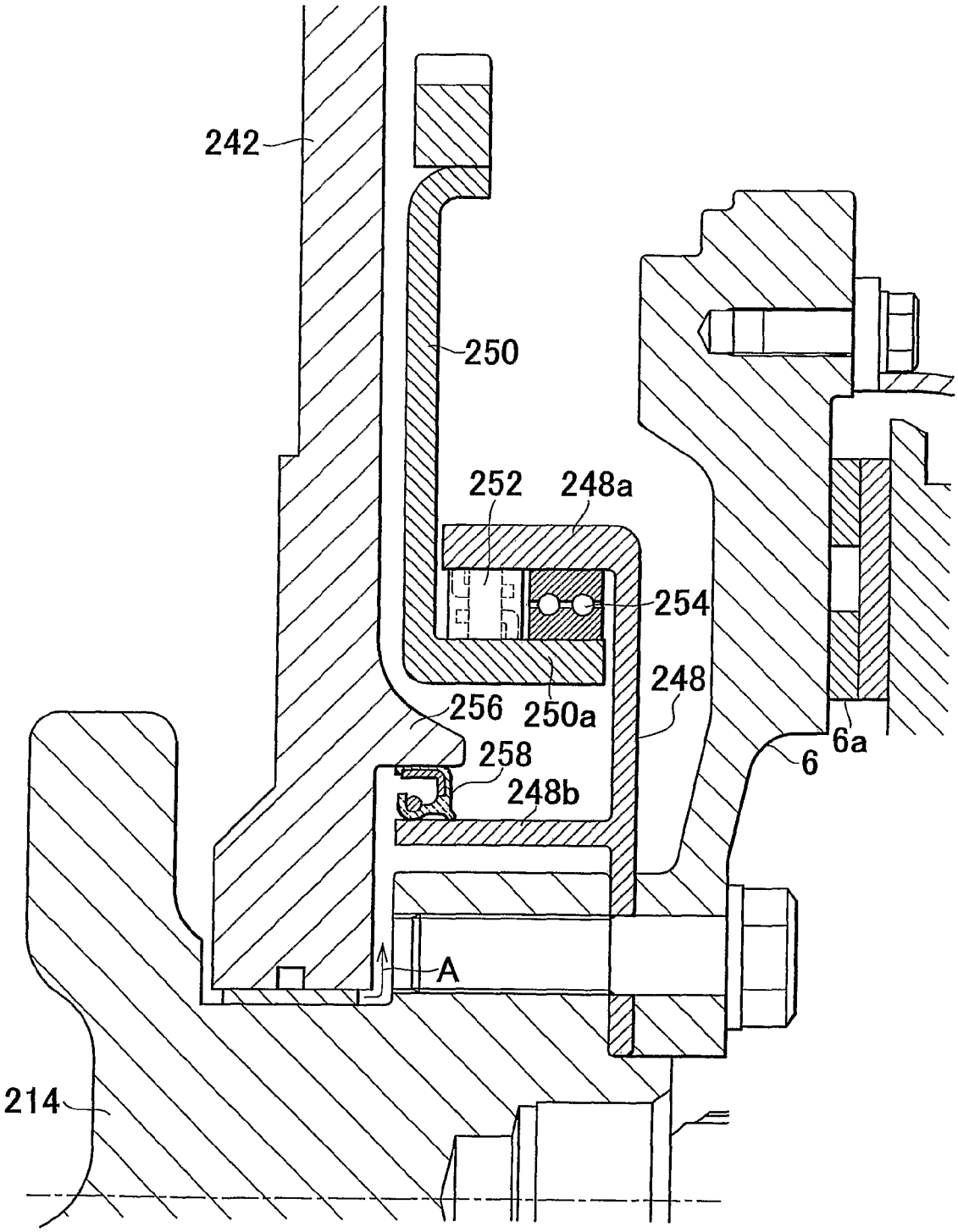
FIG. 11 is a longitudinal sectional view of a startup torque transmitting mechanism of an internal combustion engine according to an eleventh embodiment of the invention.

A startup torque transmitting mechanism of an internal combustion engine according to an eleventh embodiment of the invention is shown in the longitudinal sectional view in FIG. 11. In this embodiment, the structures of the flywheel 6 and the crankshaft 214 are the same as they are in the startup torque transmitting mechanism of an internal combustion engine according to the tenth embodiment (FIG. 10) and will therefore be denoted by the same reference numerals. Also, a cylinder block 242, a ring gear 250, a grease-filled one-way clutch 252, a grease-filled bearing 254, and an oil seal member 258 are also basically the same shapes as they are in the tenth embodiment, although their respective arrangements and diameters are different.

The eleventh embodiment differs from the tenth embodiment in that a short cylindrical seal sliding portion 248*b* is formed to the inner peripheral side of an outer race 248*a* on an outer race support plate 248, as well as in that an oil seal member 258 is arranged between an oil seal mounting portion 256 of the cylinder block 242 and the seal sliding portion 248*b* instead of between the oil seal portion 256 and the crankshaft 214.

The eleventh embodiment described above can achieve the following effects.

(I) Although the oil seal member 258 is lifted up slightly in the radial direction by the seal sliding portion 248*b*, the same effects obtained by the tenth embodiment can also be obtained by this embodiment.

Twelfth Embodiment

Figure 12:
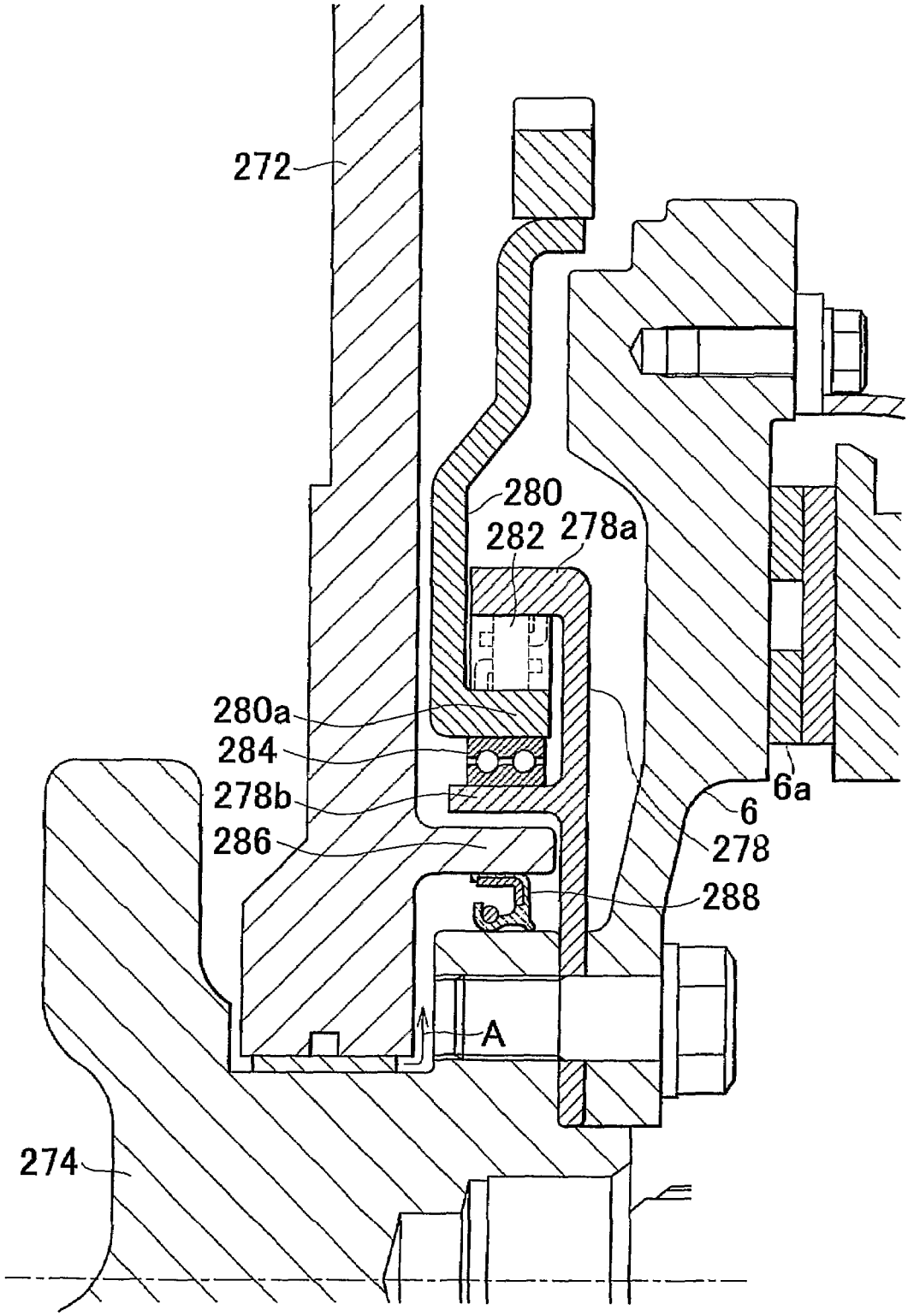
FIG. 12 is a longitudinal sectional view of a startup torque transmitting mechanism of an internal combustion engine according to a twelfth embodiment of the invention.

A startup torque transmitting mechanism of an internal combustion engine according to a twelfth embodiment of the invention is shown in the longitudinal sectional view in FIG. 12. In this embodiment, the structure of the flywheel 6 is the same as it is in the startup torque transmitting mechanism of an internal combustion engine according to the eleventh embodiment (FIG. 11) and will therefore be denoted by the same reference numeral. Also, a cylinder block 272, a crankshaft 274, an outer race support plate 278, a ring gear 280, a grease-filled one-way clutch 282, a grease-filled bearing 284, and an oil seal member 288 are also basically the same shapes as they are in the eleventh embodiment, although their respective arrangements and diameters are different.

The twelfth embodiment differs from the eleventh embodiment in that the outer race support plate 278 has, to the inner peripheral side of an outer race 278*a*, a support cylindrical portion 278*b* which does not serve as a seal sliding portion but rather supports the bearing 284 on its outer peripheral side. In this case, the oil seal member 288 is arranged between the crankshaft 274 and an oil seal mounting portion 286 of the cylinder block 272. An inner race 280*a* of the ring gear 280 is formed to be inserted between the support cylindrical portion 278*b* and the outer race 278*a* of the outer race support plate 278. The one-way clutch 282 is then arranged between the inner race 280*a* and the outer race 278*a*, and the bearing 284 is arranged between the inner race 280*a* and the support cylindrical portion 278*b*.

As a result, the ring gear 280 is rotatably supported by the outer race support plate 278 via the bearing 284, and engages with the outer race support plate 278 when rotated in one direction and disengages when rotated in the other direction by means of the one-way clutch 282.

The twelfth embodiment described above can achieve the following effects.

(I) The same effects obtained by the tenth embodiment are also obtained by this embodiment.

(II) The one-way clutch 282, the bearing 284, and the oil seal member 288 are radially arranged in the same position in the axial direction. As a result, the startup torque transmitting mechanism of an internal combustion engine can be made shorter in the axial direction, thereby contributing to a smaller internal combustion engine.

(III) The bearing 284 is arranged on the inner peripheral side of the one-way clutch 282 so its peripheral velocity is reduced, thereby improving reliability.

Thirteenth Embodiment

Figure 13:
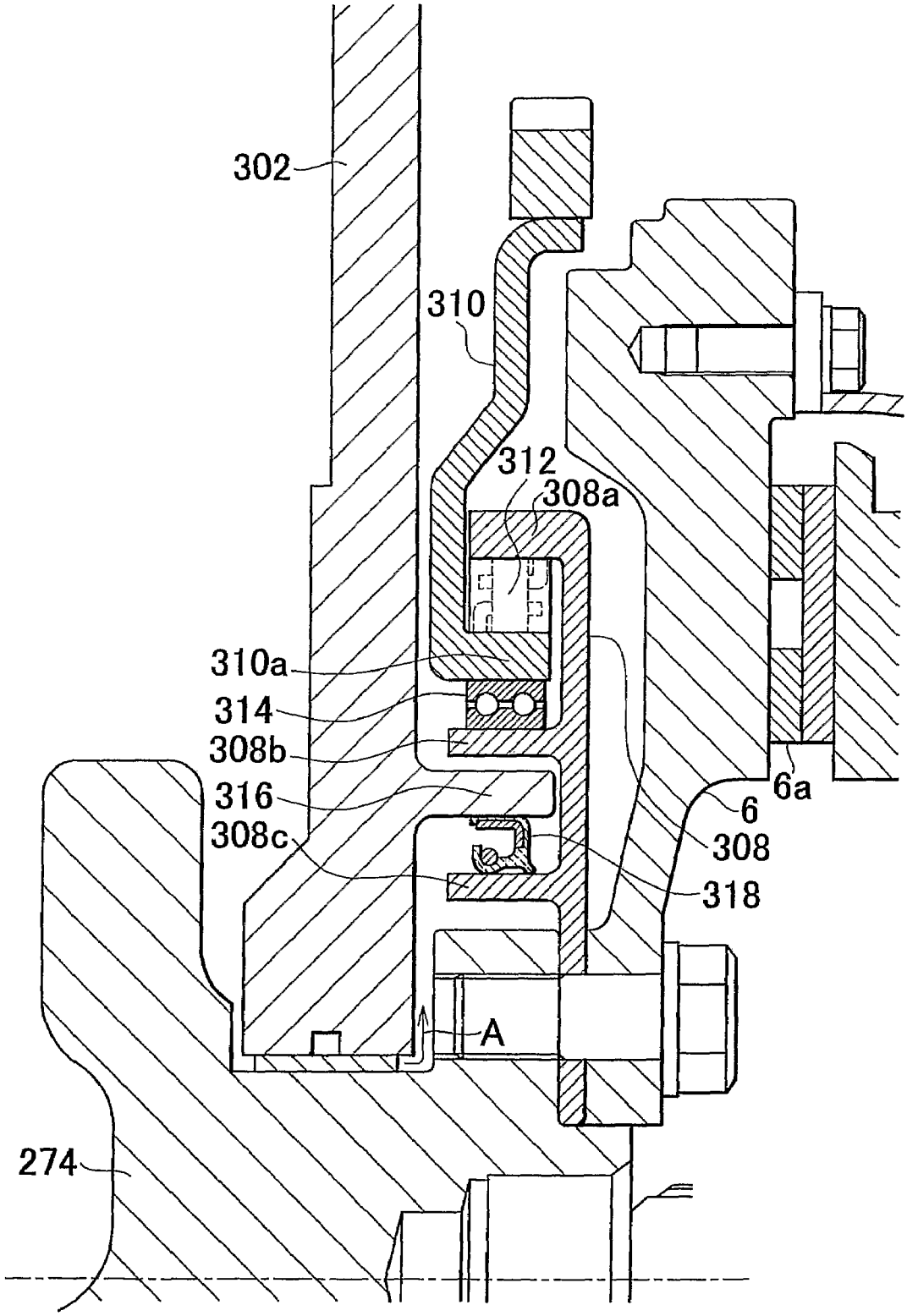
FIG. 13 is a longitudinal sectional view of a startup torque transmitting mechanism of an internal combustion engine according to a thirteenth embodiment of the invention.

A startup torque transmitting mechanism of an internal combustion engine according to a thirteenth embodiment of the invention is shown in the longitudinal sectional view in FIG. 13. In this embodiment, the structures of the flywheel 6 and the crankshaft 274 are the same as they are in the startup torque transmitting mechanism of an internal combustion engine according to the twelfth embodiment (FIG. 12) and will therefore be denoted by the same reference numerals. Also, a cylinder block 302, a ring gear 310, a grease-filled one-way clutch 312, a grease-filled bearing 314, and an oil seal member 318 are also basically the same shapes as they are in the twelfth embodiment, although their respective arrangements and diameters are different.

The thirteenth embodiment differs from the twelfth embodiment in that an outer race support plate 308 has a support cylindrical portion 308*b* which, supports a bearing 314 on its outer peripheral side, provided to the inner peripheral side of an outer race 308*a*, and a seal sliding portion 308*c* provided even farther to the inner peripheral side. The oil seal member 318 is arranged between the oil seal mounting portion 316 of the cylinder block 302 and the seal sliding portion 308*c*.

The relationships between the inner race 310*a* of the ring gear 310, the support cylindrical portion 308*b* and the outer race 308*a* of the outer race support plate 308, the one-way clutch 312, and the bearing 314 are the same as those in the twelfth embodiment.

The thirteenth embodiment described above can achieve the following effects.

(I) Although the seal sliding portion 308*c* is lifted up slightly in the radial direction, the same effects obtained by the twelfth embodiment can also be obtained by this embodiment.

(II) The radial position of the seal sliding portion 308*c* can be adjusted to achieve the appropriate circumference of each portion, particularly the one-way clutch 312, of the startup torque transmitting mechanism of an internal combustion engine. As a result, the appropriate number of sprags and appropriate sprag widths can be selected, thus making it easier to design the startup torque transmitting mechanism of an internal combustion engine. Accordingly, as described in (II) of the fourth embodiment, the startup torque transmitting mechanism of an internal combustion engine can be made shorter in the axial direction, thereby contributing to a smaller internal combustion engine.

Fourteenth Embodiment

Figure 14:
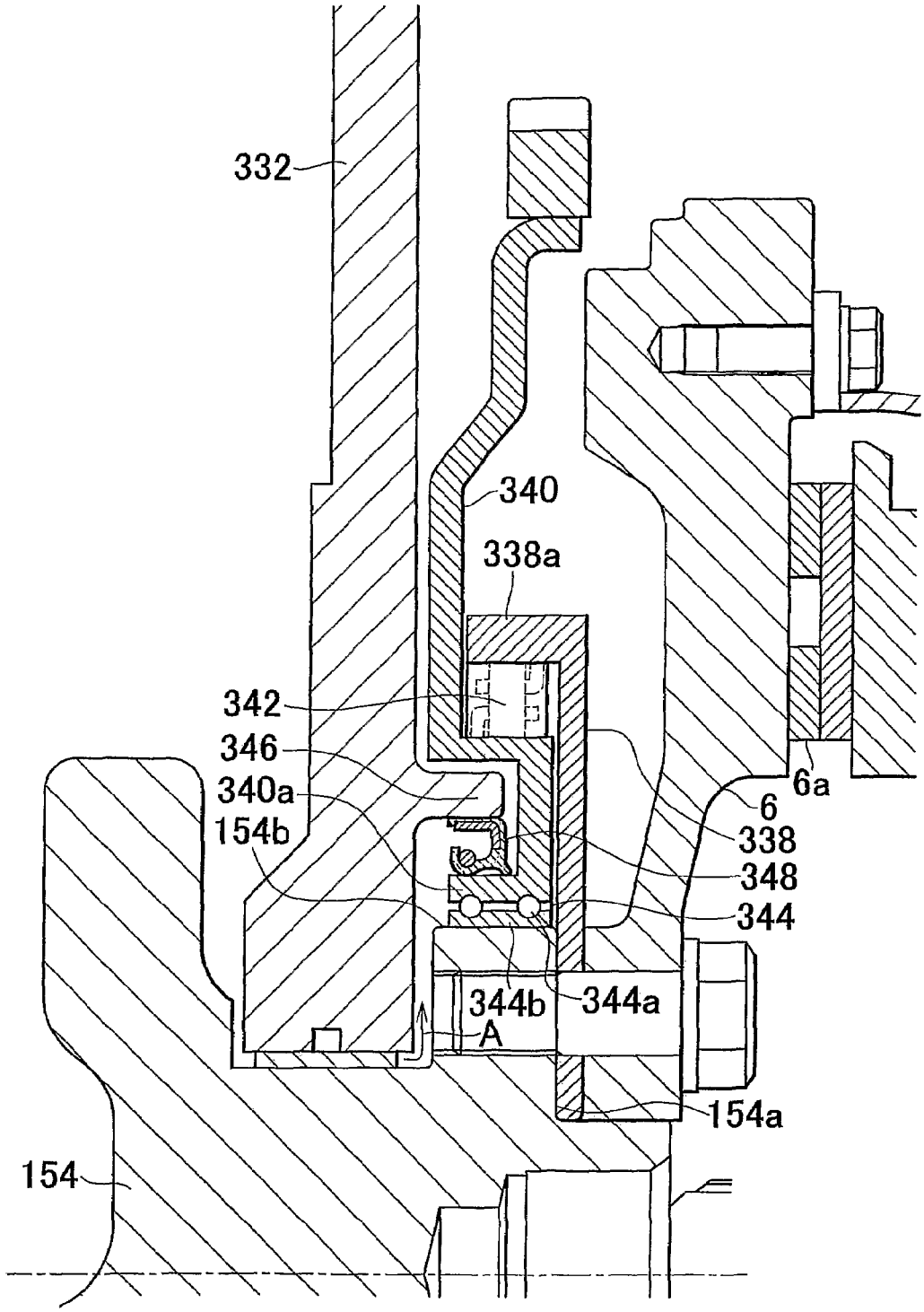
FIG. 14 is a longitudinal sectional view of a startup torque transmitting mechanism of an internal combustion engine according to a fourteenth embodiment of the invention.

A startup torque transmitting mechanism of an internal combustion engine according to a fourteenth embodiment of the invention is shown in the longitudinal sectional view in FIG. 14. In this embodiment, the structures of the flywheel 6 and the crankshaft 154 are the same as they are in the startup torque transmitting mechanism of an internal combustion engine according to the sixth embodiment (FIG. 6) and will therefore be denoted by the same reference numerals. Also, a cylinder block 332, an outer race support plate 338, a grease-filled one-way clutch 342, and an oil seal member 348 are also basically the same shapes as they are in the sixth embodiment, although their respective arrangements and diameters are different.

The fourteenth embodiment differs from the sixth embodiment in that the inner peripheral portion of the ring gear 340 is formed as an outer race 340*a* of a bearing 344 having an integrated oil seal. A ball 344*a*, an inner race 344*b*, and the oil seal function fit together with the outer race 340*a* to form the bearing 344 having an integrated oil seal, which is fitted to an outer peripheral surface 154*b* of the crankshaft 154. The portion where the inner race 344*b* fits onto the crankshaft 154 does not slide so it may also be sealed with an O-ring.

Because the bearing 344 is integrally formed on the inner peripheral side of the ring gear 340 in the way, the portion where the bearing 344 fits on the ring gear 340 is no longer necessary, which enables the overall diameter, in particular, to be reduced.

The fourteenth embodiment described above can achieve the following effects.

(I) The same effects obtained by the sixth embodiment are also obtained by this embodiment.

(II) As described above, the diameter of the entire startup torque transmitting mechanism of an internal combustion engine can be reduced, thereby contributing to a lighter and smaller internal combustion engine.

Other Embodiments (I) In each of the foregoing embodiments, the outer race support plate is provided separate from the flywheel. Alternatively, however, the outer race support plate may also serve as the flywheel. That is, the seal sliding portion, the support cylindrical portion, and the outer race formed on the outer race support plate may also be formed on the flywheel side. Also, with an internal combustion engine in which there is no flywheel, such as an internal combustion engine having a drive plate connected to a torque converter, the seal sliding portion, the support cylindrical portion, and the outer race may also be provided on this drive plate.

(II) In the fourteenth embodiment (FIG. 14), the outer race 340*a* of the bearing 344 is integrated with the inner peripheral side of the ring gear 340. The outer race of the bearing may be integrated with the inner peripheral side of the ring gear in this manner in the other embodiments as well.

While the invention has been described with reference to exemplary embodiments thereof, it is to be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other combinations and configurations, including more, less or only a single element, are also within the spirit and scope of the invention.

The invention claimed is:

1. A startup torque transmitting mechanism of an internal combustion engine, comprising:

a ring gear to which torque from a starter motor side is transmitted;

a crankshaft side member which rotates in conjunction with a crankshaft;

a one-way clutch which is arranged between the ring gear and the crankshaft and which transmits torque generated by the starter motor from the ring gear to the crankshaft in one direction and prevents torque from being transmitted in the other direction, and requires no supply of lubrication oil;

a bearing which is arranged between the crankshaft or the crankshaft side member and a surface of the ring gear that faces in the opposite direction from the side of the ring gear on which the one-way clutch is arranged;

a first oil seal member which is arranged together with the bearing between the crankshaft or the crankshaft side member and the surface of the ring gear that faces in the opposite direction from the side of the ring gear on which the one-way clutch is arranged, and is arranged on the opposite side of the bearing from the internal combustion engine main body; and a second oil seal arranged between the ring gear and the internal combustion engine main body.

2. The startup torque transmitting mechanism of an internal combustion engine according to claim 1, wherein the ring gear forms an inner race of the one-way clutch and the crankshaft side member forms an outer race of the one-way clutch.

3. The startup torque transmitting mechanism of an internal combustion engine according to claim 1, wherein both the bearing and the one-way clutch are grease-filled.

4. The startup torque transmitting mechanism of an internal combustion engine according to claim 2, wherein both the bearing and the one-way clutch are grease-filled.

5. The startup torque transmitting mechanism of an internal combustion engine according to claim 1, wherein the one-way clutch is grease filled.

6. The startup torque transmitting mechanism of an internal combustion engine according to claim 1, wherein the one-way clutch is formed between a surface formed by the ring gear that faces in the outer radial direction and a surface formed by the crankshaft side member that opposes that surface and faces in the inner radial direction.

* * * * *